US005339092A

United States Patent [19]

Johnson et al.

[11] Patent Number: 5,339,092

[45] Date of Patent: Aug. 16, 1994

[54] BEAM FORMER FOR MATRIX DISPLAY

[75] Inventors: Michael J. Johnson; William R. Hancock, both of Phoenix; Brent H. Larson, Glendale, all of Ariz.

[73] Assignee: Honeywell Inc, Minneapolis, Minn.

[21] Appl. No.: 5,851

[22] Filed: Jan. 13, 1993

Related U.S. Application Data

[63] Continuation of Ser. No. 823,578, Jan. 16, 1992, abandoned, which is a continuation of Ser. No. 432,105, Nov. 6, 1989, abandoned.

[51] Int. Cl.[5] ..... G09G 5/36; G09G 3/20; G09G 3/36

[52] U.S. Cl. ..... 345/136; 345/138

[58] Field of Search ..... 340/701, 702, 703, 723, 340/728, 732, 744, 767, 793; 395/128, 131, 132, 143; 345/136, 137, 138

[56] References Cited

U.S. PATENT DOCUMENTS

| | | | |
|---|---|---|---|
| 4,808,988 | 2/1989 | Burke et al. | 340/744 |
| 4,843,380 | 6/1989 | Oakley et al. | 340/723 |
| 4,853,592 | 8/1989 | Strathman | 340/767 |
| 4,931,956 | 6/1990 | Stapleton | 395/128 |
| 4,939,671 | 7/1990 | Sasser | 340/739 |
| 4,952,921 | 8/1990 | Mosier | 340/728 |
| 5,122,783 | 6/1992 | Bassetti, Jr. | 340/701 |

OTHER PUBLICATIONS

"Micromatrix Image Processor for Color Matrix Displays" by J. N. Perbet et al., published in *Japan Display*, pp. 594–597, of the Proceedings of the Ninth International Display Research Conference of Oct. 16–18, 1989, in Kyoto, Japan.

Text Book, "Fundamentals of Interactive Computer Graphics," by Foley and Van Dam, Jul. 1984, pp. 129 to 140.

"Dejagging Raster Graphics Displays by Flash Filtering", by D. Oakley et al., Proceedings of the Society for Information Display, vol. 28, No. 4, 1987 pp. 425–429.

*Primary Examiner*—Jeffery Brier

*Attorney, Agent, or Firm*—B. C. Downs; M. J. Gebhardt; R. E. Champion

[57] ABSTRACT

A graphics system having a beamformer operating on image data and sub-pixel or fractional address data coming from a modified image memory and graphics processor producing correctly anti-aliased data to be shown on raster displays and in particular on color mosaic active matrix displays.

14 Claims, 32 Drawing Sheets

| | | | | | |
|---|---|---|---|---|---|
| GREEN RED | | | | | RED |
| | GREEN RED | | | RED | |
| | | GREEN RED | RED | | |
| | | RED | GREEN RED | | |
| | RED | | | GREEN RED | |
| RED | | | | | GREEN RED |

*Fig. 8*

| | | | | | |
|---|---|---|---|---|---|
| GREEN | | | | | |
| | GREEN | | | | |
| | | GREEN | | | |
| | | | GREEN | | |
| | | | | GREEN | |
| | | | | | GREEN |

*Fig. 9*

| | | | | | |
|---|---|---|---|---|---|
| RED | | | | | RED |
| | RED | | | RED | |
| | | RED | RED | | |
| | | RED | RED | | |
| | RED | | | RED | |
| RED | | | | | RED |

*Fig. 10*

MODIFIED PING OR PONG PORTION OF IMAGE MEMORY

BEAM FORMER FOR MATRIX DISPLAY

This application is a continuation of application Ser. No. 07/823,578, filed Jan. 16, 1992 which is a continuation application of application Ser. No. 07/432,105 filed Nov. 6, 1989 both of which are now abandoned.

BACKGROUND AND SUMMARY OF THE INVENTION

1. Field of the Invention

This invention relates to the area of computer image generation in general and techniques for anti-aliasing, computer generated images in particular. There is described the applying an anti-aliasing filter to the output of a sub-pixel image memory configuration to improve image quality in displays in general and in color mosaic displays in particular. The result is smoother more stroke-like images.

2. Background

The problem being confronted with flat panel matrix displays and/or raster displays is that the discrete nature of some display systems results in a discontinuous or jagged looking output such as the aliased line 10 in a simulated display 11 of FIG. 1. This contrasts with the widely accepted high quality stroke 12 as would be seen on a CRT display where each line is smooth and continuous (i.e. an anti-aliased line). Without anti-aliasing, computer generated imagery on raster displays typically shows disturbing artifacts: moire patterns, rainbow effects, jagged edges, discontinuous motion, loss of detail and/or scintillation. These artifacts are all manifestations of a more general problem called aliasing. Aliasing results when the detail or spatial frequency content of the image to be displayed exceeds the sampling bandwidth capability of the display system. Fortunately, according to sampling theory, aliasing can be eliminated completely. To remove it, the signal to be sampled must first be bandlimited to include no frequencies higher than ½ the sampling frequency of the system. To prevent artifacts from appearing on an image, the image itself must first be bandlimited so its spatial frequency content meets this criterion.

In computer generated image systems, the image can be expressed as a signal whose amplitude varies as a function of position across the surface of the display. As more detail is added to the image, this signal changes more rapidly across the screen. As the signal rises and falls more rapidly, the effect is to raise the spectral energy content of the image into higher spatial frequency regions. Therefore, bandlimiting a computer generated image means the computer must be programmed to prevent sudden transitions. Pixels in the vicinity of detail, lines or edges of polygons, for example, are shaded such that the signal rises and falls at the appropriate rate. The appropriate rate is determined using sampling theory as discussed above.

In the prior art attempts have been made in the CPU (central processing unit) for mathematically determining the appropriate intensity for each pixel on the display. A weighted filter/convolution was done over a windowed region with the result used as an index for the appropriate intensity value. Some hardware implementations apply an intensity value to pixels on either side of the desired pixel. This method is typically selected when a vector generator is used to render the graphics symbols.

The prior art most commonly used a write cycle architecture, i.e., the computer bandlimited the image while the image was being written into memory. Many different algorithms have been developed over the years to provide anti-aliasing. One of the more common techniques was based on how far pixels were from a given feature. For each neighboring pixel, the distance from the feature, an edge for example, was determined. The further the pixel was from the edge, the less influence the edge exerted over the intensity assigned to that pixel. Smoother luminance transitions resulted, the spectral content of the image was limited appropriately to the lower frequencies and the aliasing artifacts were eliminated.

Another popular method, theoretically more precise, assigned intensity or color values to neighboring pixels as a function of the area of overlap; the more a pixel was covered by a particular feature, the more influence the feature exerted over that pixel. For example, a pixel covered entirely by a polygon would be assigned the full value required by that polygon. If, on the other hand, the pixel lay on the edge of the polygon, such that only a third of the pixel was covered, then the pixel would be illuminated with only a third of the value prescribed by the polygon. This method also achieved an effective low pass filter operation across the image and limited spatial frequency content as required. Anti-aliasing was successfully achieved here as well.

Alternatively and most precise, for non-real-time applications, the filter convolution method has been used. The bandwidth of an image was reduced by sliding a window processing kernel over a source image whose resolution was higher than that of the desired output. A three by three processing kernel was typically selected. In the processing kernel, numbers corresponding to a particular point spread function were stored. The transfer function and shape of the point spread function were derived from sampling theory. The kernel was slid across and down the source image pixel by pixel, resulting in a straightforward convolution process. Convolution of this kernel with a high resolution source image resulted in an output image whose spatial bandwidth matched that of the sampling display system, so aliasing, once again, was circumvented.

The above three categories of anti-aliasing are all write cycle based. As such, they suffer serious drawbacks when required to deliver high resolution real-time performance. Speed is the critical issue. The increased burden anti-aliasing places on systems of even modest resolutions, 512×512 for instance, has pressed write cycle architectures to the limit. Processing elements must be selected for much higher performance and cost. Of course parallel techniques can be invoked to alleviate some of the problems but then control and system flexibility flare up to become major issues.

Write cycle architectural problems are exacerbated further when color mosaic display technology is used in the display device. The resolution of this emerging technology can be several times more than that which has already proven difficult. The trend points to higher resolutions still. In addition, the particular color pattern of the mosaic must be taken into account by the graphics generator in order that it can successfully render anti-aliased imagery. Color pattern considerations enable the image generator to tailor the frequency content of the image to the specific capabilities of a given color mosaic display. In summary of this background, write-cycle anti-aliasing entails considerable expense when generating high resolution, real-time imagery, especially when targeting color mosaic displays.

SUMMARY

The present invention provides effective anti-aliasing by approaching the problem from a different viewpoint than the mentioned prior art, one at the systems level: instead of burdening the computer with the highly repetitive task of filtering the image wherever image detail resides, the invention reallocates as much of the redundant activity as possible to a new component 23 on the output side or, as it is commonly known, the read side of the image memory (FIG. 3). In the present invention each active pixel in the image memory is expanded out into a gaussian profile in a beamformer 23 (i.e., the new component). This is shown pictorially at 13 in FIG. 2 which pictorially illustrates this expansion.

The new system component is called the beamformer. It assumes the extra burden of performing the anti-aliasing and acts as a matching filter between the graphics generator and the display device 22. It limits the bandwidth of the image in accordance with sampling theory and utilizes sub-pixel information as a means of extending the apparent sampling frequency of the system, especially with respect to the display head if color mosaic displays are used. In this new system, the beamformer resides between the display device and the computer (FIG. 3*b*). The significant features of the beamformer are: a) It expands the impulse data from image memory 21*a*, into the point spread function 13, whose bandwidth lies within the capability of the sampling system, which can be the display 22; and b) It uses sub-pixel information from the graphics generator system 24, to adjust the centroid of luminance of the point spread function 13, to appear between sampling points, which can be those of the display 22, thus allowing higher positional addressability.

Inside the computer, only a few functional modules need to be modified for this new system approach to operate. In FIG. 3*b*, the first functional module, the graphics generator 20*a*, must provide sub-pixel information in addition to standard integer positional address output. Sub-pixel information is typically available in the prior art, though often unused outside the graphics generator.

The other module, the image memory 21*a*, must be modified to include storage for the new sub-pixel information provided by the graphics generator. The image memory must provide this storage in addition to providing the usual storage for color and attribute information. The invention, therefore, comprises the new beamformer component 23, in addition to these modified elements 20*a* and 21*a*, of the computer.

The benefits of this invention include: substantially enhanced processing throughput, system simplicity, and lower cost especially with respect to color mosaic display technology. It is a further advantage of this invention that it most effectively anti-aliases color mosaic displays. In addition, the invention can afford a large degree of independence of the graphics processor from the resolution and pixel arrangement of the display technology.

Thus, the beamformer 23 operates on data coming out of the image memory and produces correctly anti-aliased data to be shown on the display. It looks at a window of data from the image memory and computes the appropriate intensity value to be displayed. It moves the function of anti-aliasing from the graphics generator to a separate, dedicated hardware section. The beamformer solves several problems of the conventional system. The graphics generator is free from having to do any anti-aliasing work, thus increasing the system throughput. Also, the beamformer does all the processing associated with color mosaic displays again increasing the system throughput by reducing the graphics generator workload.

BRIEF DESCRIPTION OF THE DRAWINGS

FIG. 8 is a color processing example. There is illustrated a sliding window in image memory containing a yellow (red and green) line and a red line.

FIG. 9 is a color processing example of color sorting performed for a green next output pixel.

FIG. 10 is a color processing example of color sorting performed for a red next output pixel.

DESCRIPTION OF THE PREFERRED EMBODIMENT

Figure 3A:
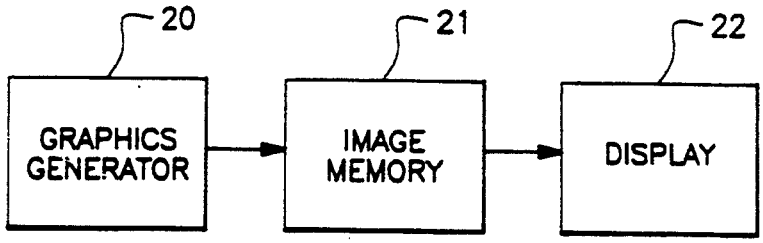
FIG. 3*a* illustrates a conventional image processing architecture utilizing a write cycle anti-aliasing method. Anti-aliasing is performed by the graphics processor as the image is drawn and written into the image memory.
Figure 3B:
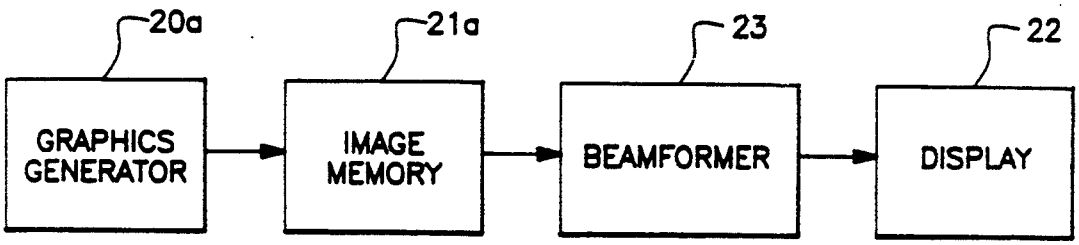
FIG. 3*b* illustrates the invention driving a display. The beamformer module has been added to a modified system that is now a read cycle anti-aliasing system.
Figure 4:
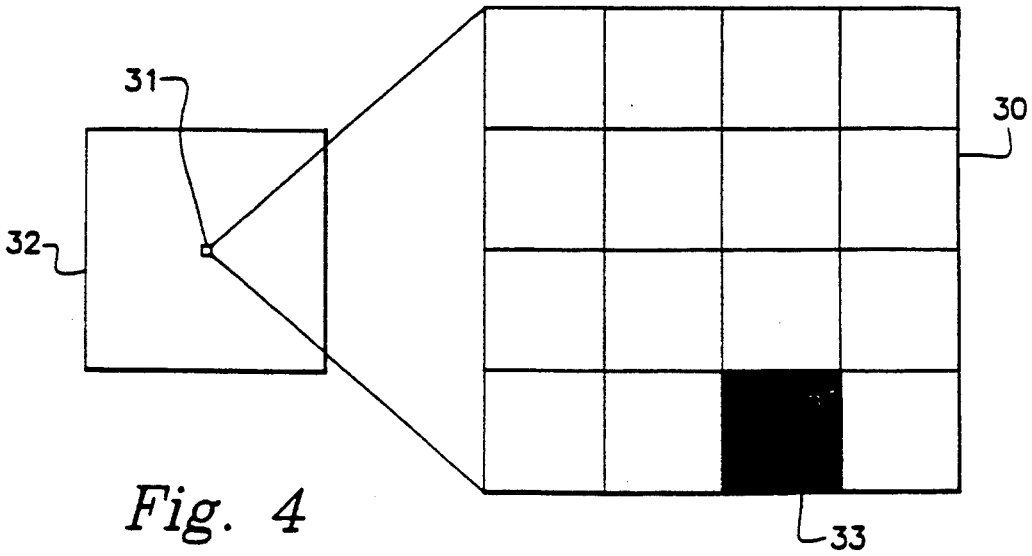
FIG. 4 depicts the idea of sub-pixel position within a pixel within image memory. A sub-pixel location is marked as an example of where within a pixel the invention can be instructed to place the centroid of luminance.
Figure 5:
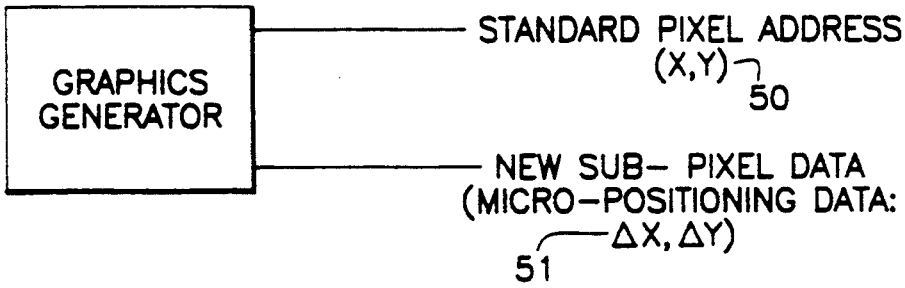
FIG. 5 depicts the modified form of the graphics processor used in the invention. Instead of providing standard integer x and y address values with which to address the image memory, the modified vector generator also provides sub-pixel or fractional address data.
Figure 5A:
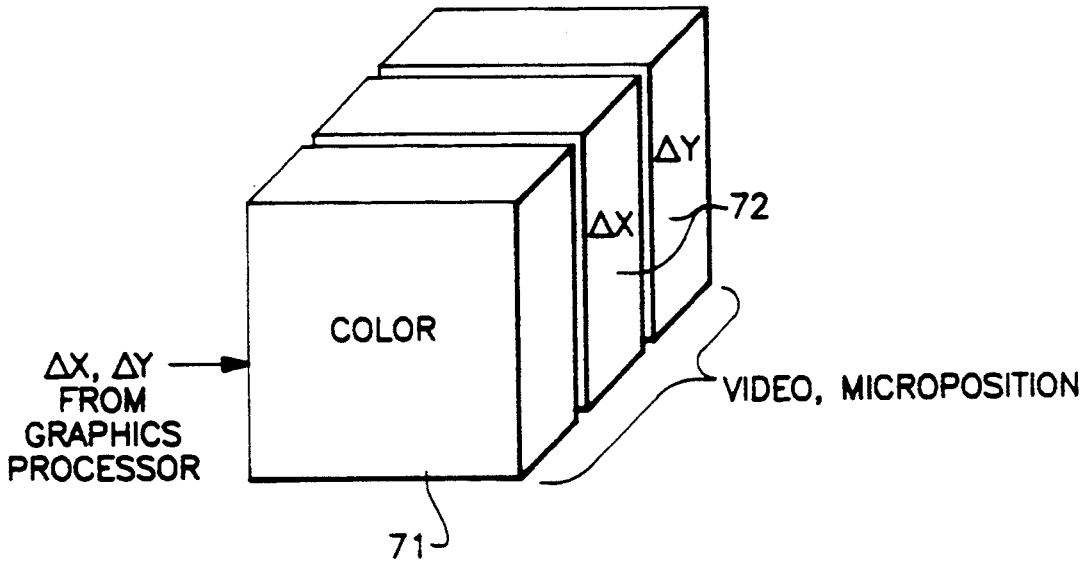
FIG. 5*a* shows the modified form of image memory. Storage for color or attribute data, etc. 71 is shown as is storage for the sub-pixel address information 72, obtained from the modified vector generator.

In FIG. 3A there is shown a conventional display system with a graphics generator 20, an image memory 21 and a matrix display 22. FIG. 3B shows a preferred embodiment of the invention. It includes the modified graphics generator **20*a*, the modified image memory 21*a*, and the beamformer filter element 23 together with display 22. In FIG. 5, the modified graphics generator 20*a* is shown. Instead of providing only standard integer x and y address values 50, with which to address the image memory, the modified graphics generator also provides sub-pixel or fractional address data 51. This sub-pixel or fractional address information 51 can be used to direct a subsequent system element, the beamformer 23, to adjust light energy to positions between discrete pixels. In terms of sampling theory, the sub-pixel information provides additional information about the sampled point to be written into image memory. It provides the phase of the sampled amplitude data. Referring to FIG. 4, the sub-pixel information can be used to place light energy at any of 16 positions, for example, within a discrete pixel 31, in image memory 32. An expanded view 30, of pixel 31 depicts the sub-pixels that can be made available to the display system for finer placement precision of light energy which will form the image. Sub-pixel 33**, for example, may be designated by the graphics generator and stored in the modified image memory.

Referring now to FIG. **5*a* the modified form of image memory 21*a* is shown. Instead of providing storage only for color or attribute data, etc. 71 the modified image memory also provides storage for the sub-pixel address information 72**, obtained from the modified graphics generator. Upon readout, this image memory will subsequently supply standard video information along with the sub-pixel information to the beamformer.

Figure 1:
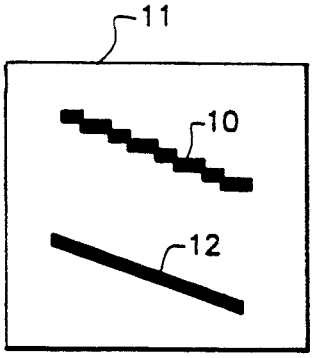
FIG. 1 illustrates the shape difference between an aliased and anti-aliased line. The aliased line is jagged, while the anti-aliased line is smooth and continuous.
Figure 2:
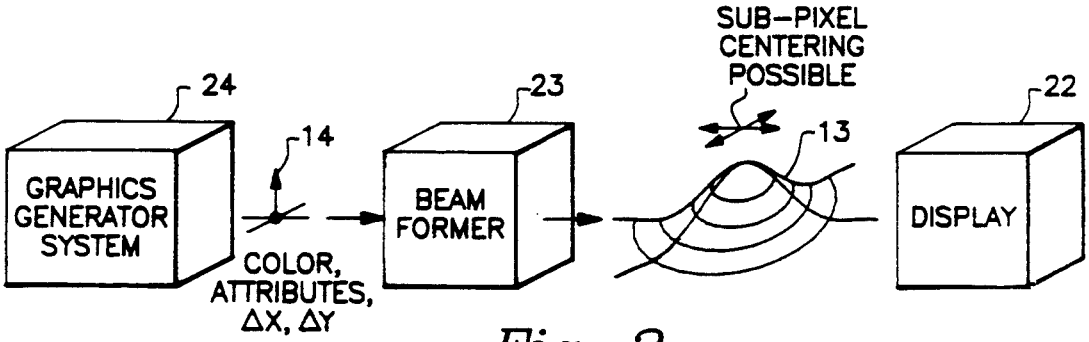
FIG. 2 pictorially illustrates the input/output relationship of the beamformer component. The input is impulse data from the graphics generator system. The output is the point spread function of the beamformer convolved with the impulse input. Sub-pixel centering results, providing higher placement precision of color energy on the display.

Referring once again to FIG. 2 or **3*b*, the beamformer 23 is shown. Its input output relationship illustrates that it behaves very much like a standard two dimensional image processing filter. An impulse from image memory applied to the input of the beamformer emerges at the output of the beamformer in expanded form. The expansion is the point spread function of the beamformer, corresponding to this filter's spatial frequency transfer characteristics. Said another way, each active pixel in the image memory 21*a* is expanded out into a gaussian profile in the beamformer 23. The data being scanned out of the image memory 21*a* is collected by the beamformer 23** and interpreted to determine the appropriate intensity level for each pixel.

There are at least four significant differences between the beamformer and the prior art of two-dimensional image processing filters: 1) The beamformer extends two dimensional image processing filter technology to solve the problem of anti-aliasing raster images in general; 2) to solve the problem of anti-aliasing color mosaic displays in particular, 3) point spread function derived for the given pixel pattern of a color mosaic and 4) the centroid of the point spread function is micro-positionable under the direction of the input sub-pixel information. (This means the filter coefficients are a function of the input data, different from standard filter implementations.)

One other important attribute of this invention consisting of the modified graphics generator, the modified image memory and the beamformer, is its scan conversion capability. Because the beamformer 23 provides an interface between the computer and the display, the computer drawing elements, i.e., the graphics processor **20*a* and the image memory 21*a*** can be constructed to be independent of the resolution and pixel arrangement of the display. One-to-one correspondence of image memory storage locations with display pixels is not required. The beamformer provides an interpolation function between the computer and any raster display technology. This is especially useful in the case of color mosaic displays where resolution and pixel arrangement can change from display head to display head and while this display technology continues to evolve. The system benefit, then, is that the computer is stabilized and independent of such evolutions or changes. Another side benefit is that the graphics processing can be done at lower resolution effecting a still larger increase in effective throughput than that obtained through relief of the anti-aliasing burden alone. Further, read/modify/write cycles are not necessary as in the case of the prior art since anti-aliasing data are added on the output side of the image memory and therefore cannot erase underlying or previously drawn/written anti-aliased information. This effects yet another increase in effective processing throughput.

The beamformer uses sub-pixel positioning information from the image memory to more finely position the light energy on the display. It can more finely position the light energy by adjusting the centroid of luminance of its output point spread function. Since the point spread function covers an ensemble of pixels, the amount of energy from the pixels can be adjusted relative to each other and in so doing can make the energy appear to be emerging between pixels. In the preferred embodiment, the beamformer places light energy to within a third of an arc minute subtense as seen by the eye. This typically relates to one four thousandth of the screen width/height in placement accuracy. It provides vernier adjustment capability which can be used to eliminate the sampling artifacts of the display system.

Use of the beamformer also eliminates the requirement for the graphics generator to know the color arrangement of a color mosaic display as in the case of color matrix liquid crystal display (LCD) technology. Each pixel in image memory can be treated independently of the pixel arrangement in the LCD. Color can be written into image memory regardless of the display's pixel arrangement as could be done before but only with non-color mosaic display technology like that of CRT display technology. The beamformer can incorporate a color sequencer and look-up mechanism to decompose the color out of image memory into the primary color components that comprise the color mosaic pattern of a particular display. In this way, the different pixel patterns can be easily managed making the color mosaic display technology as convenient to handle as CRT technology. Typical patterns of primary colors used in color mosaic displays include the vertical RGB stripe, the diagonal RGB stripe, the delta or hexagonal RGB, the Quad-RGBG, the Honeywell Quad-RGBY and the Quad-RGBW, where RGB denote red, green and blue, and where Y and W denote yellow and white.

The beamformer 23 provides anti-aliasing intensity levels for each primary color. For example, in a raster CRT display, the intensity levels for the red, green, and blue channels would each be interpreted independently of the other color channels. Color continuity is therefore provided through the use of a beamformer.

FIG. 4 illustrates an expanded view 30 of one pixel 31 in image memory 32, whereby sub-pixel addressability can be utilized to improve apparent resolution. Sixteen sub-pixels per pixel are shown in FIG. 4 as exemplary. Sub-pixel addressability allows the luminance profile to be micropositioned, as at 33, within the expanded pixel 30. Line shape and placement is thus more precise. The sub-pixel information is stored in image memory 21*a* and used by the beamformer 23 to finely position the gaussian beam center. This increases the effective resolution of the display device 22 as the number of bits of sub-pixel addressability is increased. A 512×512 image memory with three bits of x and y subaddressability can position a pixel with an effective resolution of a 4 k×4 k image memory.

The beamformer 23 provides a new system for using a fixed configuration in the vector generator 20*a* and image memory 21*a*, with changes required only in the beamformer to drive different display devices. For example, changing from an RGB diagonal arrangement on an LCD display to an RGBG quad arrangement would require only a change in the color encoding scheme of the beamformer 23 with no changes required in the vector generator 20*a*. The vector generator draws its image with the concept that each pixel can be any color. The pixel color arrangement is entirely determined by the beamformer 23 which in turn reads the pixel arrangement from a small PROM in the preferred embodiment. The same vector generator system can drive display devices of different sizes without requiring any changes in either hardware or software. Only the beamformer is changed to change display devices.

The beamformer is a device designed to be located between image memory and a raster display to provide anti-aliasing for the display device. The beamformer contains memory to provide a window of data. The theory of operation behind the beamformer is to examine a window of data in image memory centered around the next output pixel and to determine the appropriate intensity level for the output pixel based on the data inside the sliding window.

Figure 6:
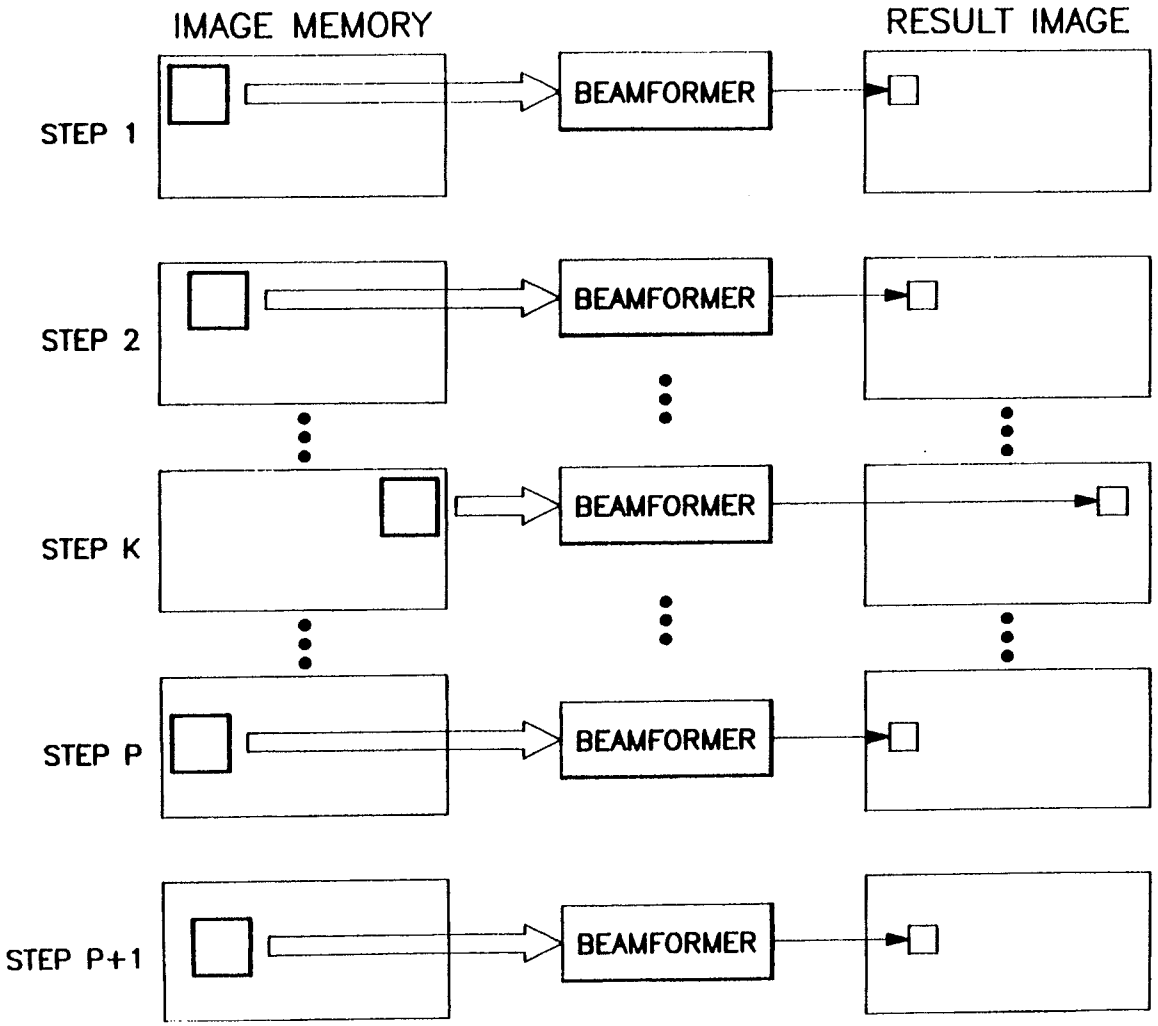
FIG. 6 illustrates an example of a sliding window used for beamformer processing, and shows how the beamformer operates. It takes a window of data from image memory and does appropriate processing to produce a single output pixel. The sliding window is moved from left to right on each line and from top to bottom.

Referring now to FIG. 6 there is an example of a sliding window used for beamformer processing and the resulting pixel displayed on the device. This figure shows an example of how the beamformer operates. It takes a window of data from image memory and performs appropriate processing to produce a single output pixel. The sliding window is moved from left to right on each line and from top to bottom in the same fashion as a typical raster display device.

The beamformer typically contains several line memories to provide access to a window of data around the next output pixel. The size of the window is determined by the geometry of the pixel pattern of the display device and the desired line width on the display. In the examples a 6×6 window will be illustrated.

Figure 7:
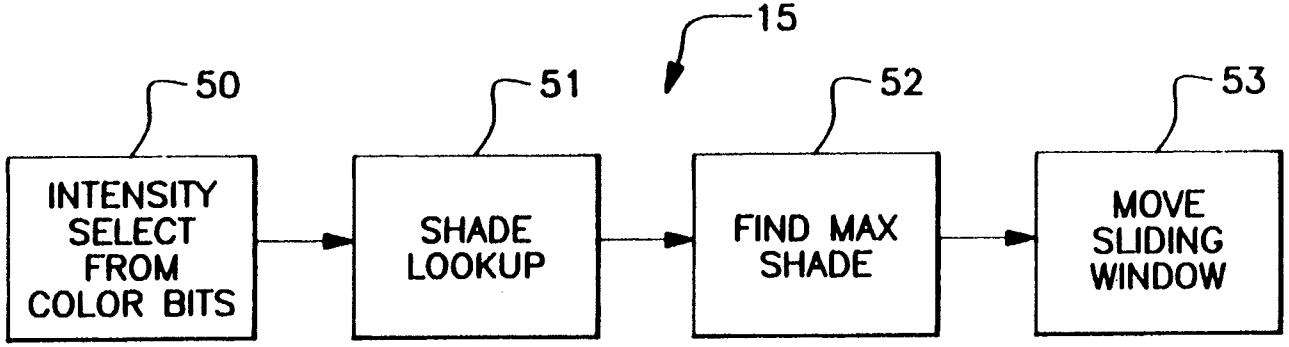
FIG. 7 illustrates the block diagram of beamformer internal details. First, color processing is done to sort data according to the next output pixel (for color mosaic displays only). Second a shade lookup is done for each active pixel in the window based on a gaussian profile. Third the shades are all compared to determine the maximum shade. Last this shade is output to the display device.

The first step of operation for the beamformer is to sort the active elements in the window by color. In FIG. 7 there is shown a block diagram of the beamformer components. The beamformer 23 comprising an intensity select from color bits component 50, a shade lookup component 51, a final maximum shade component 52, and a move sliding window component 53. The block 50 is dedicated to color processing. First, color processing is done to sort data according to the next output pixel (for color mosaic displays only). Second, a shade lookup is done for each active pixel in the window based on a gaussian profile. Third, the shades are all compared to determine the maximum shade. This maximum shade is the output to the display. FIG. 8 shows an example of the contents within a sliding window before color processing, the sliding window overlapping an image in image memory containing a yellow (green and red) line and a red line; FIG. 9 shows an example of the contents within the sliding window after color processing for a green next output pixel, and FIG. 10 shows an example of the sliding window after color processing for a red next output pixel. For raster CRTs, where each pixel contains each color, the processing is done in parallel, red on one channel, blue on one and green on a third.

After color sorting has taken place, a look-up table method of determining intensity based on distance from the center of the window is used to determine an intensity for each active pixel in the sliding window. A gaussian profile matched to the display device is used to determine the intensity for each active pixel.

Figure 11:
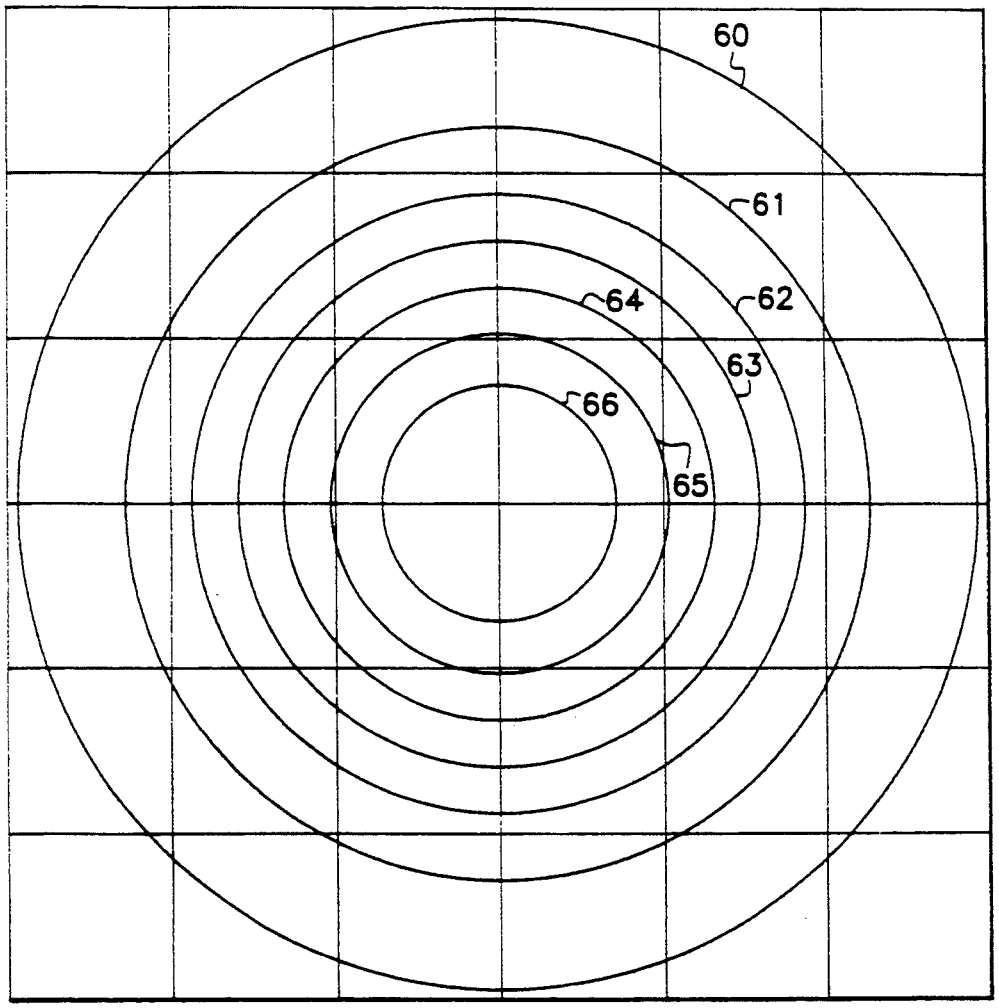
FIG. 11 shows a gaussian profile in a sliding window. This example of a gaussian profile in sliding window is used for shade lookup values.

In FIG. 11 there is shown an example of a gaussian profile inside the sliding window. Each ring 60, 61, 62, 63, 64, 65 and 66 of the profile represents an intensity level, similar to the way a topographical map represents elevation data by rings. An intensity level is computed for each active pixel in the sliding window based on this gaussian profile. Sub-pixel data is used in determining the intensity level. The sub-pixel data is used to look-up the intensity within the major blocks shown in FIG. 11. The next step in processing is to determine the maximum intensity level from all of the active pixels. This is done using comparators or another look-up table. The maximum intensity level is used as the output intensity level.

Figure 12:
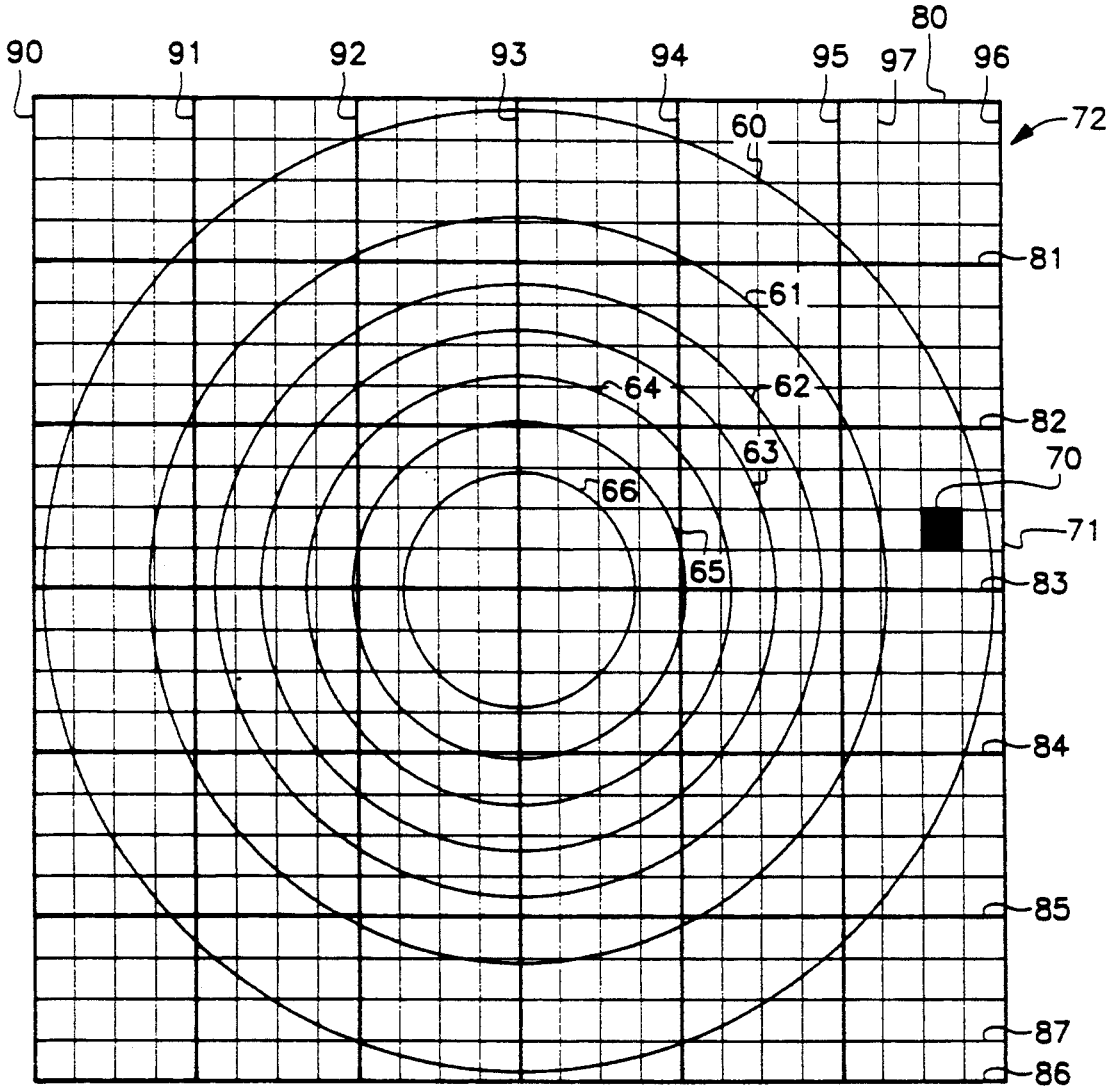
FIGS. 12–17 are sliding window examples showing one point in image memory passing through a sliding window, and represents 6 consecutive frames in time.
Figure 13:
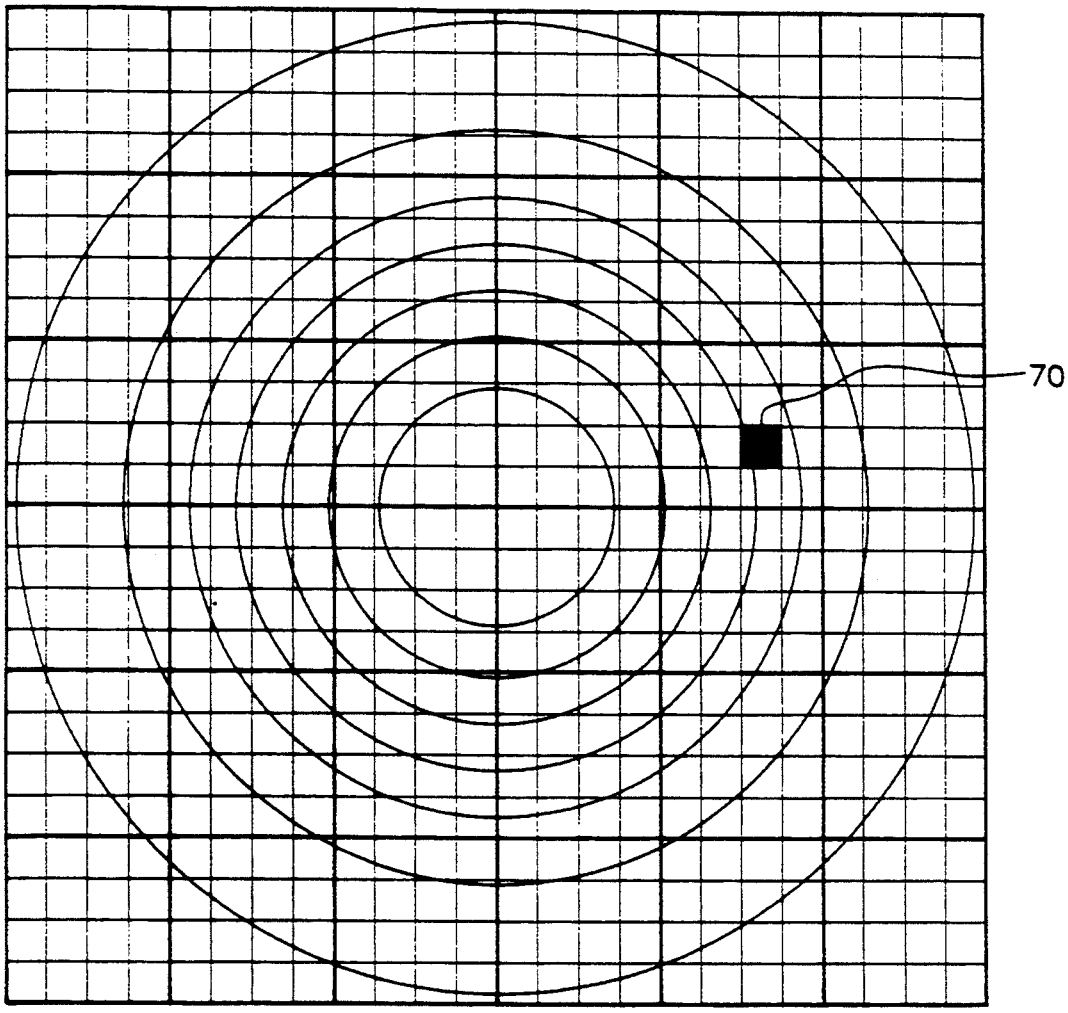
Figure 14:
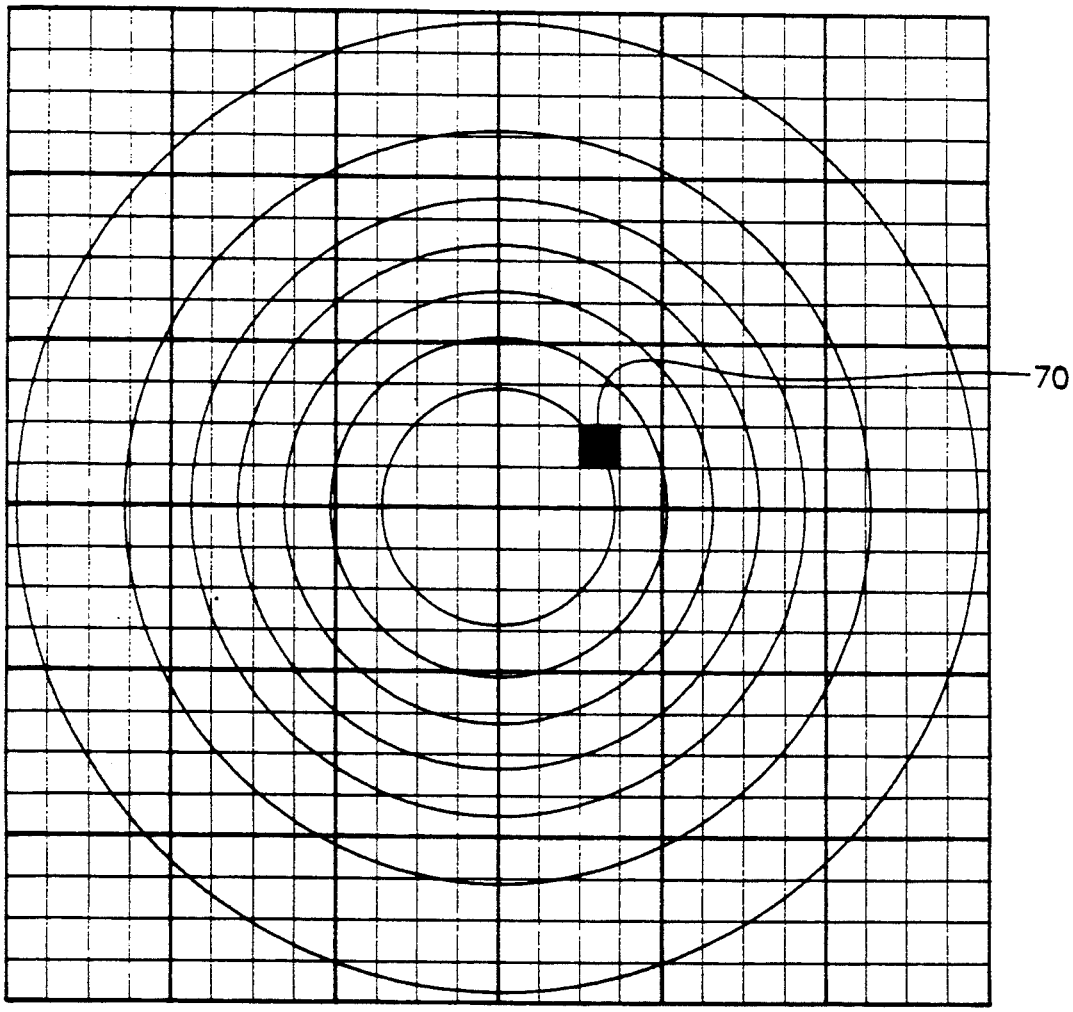
Figure 15:
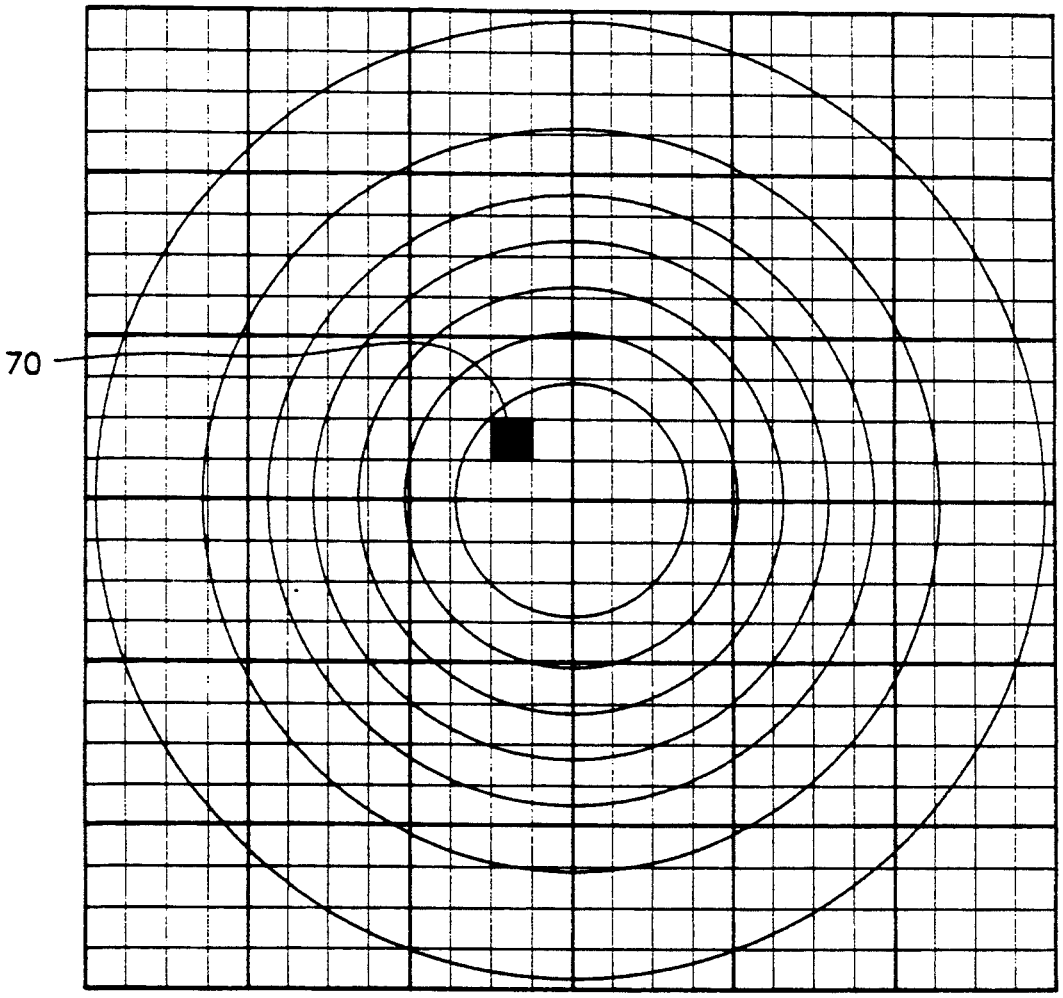
Figure 16:
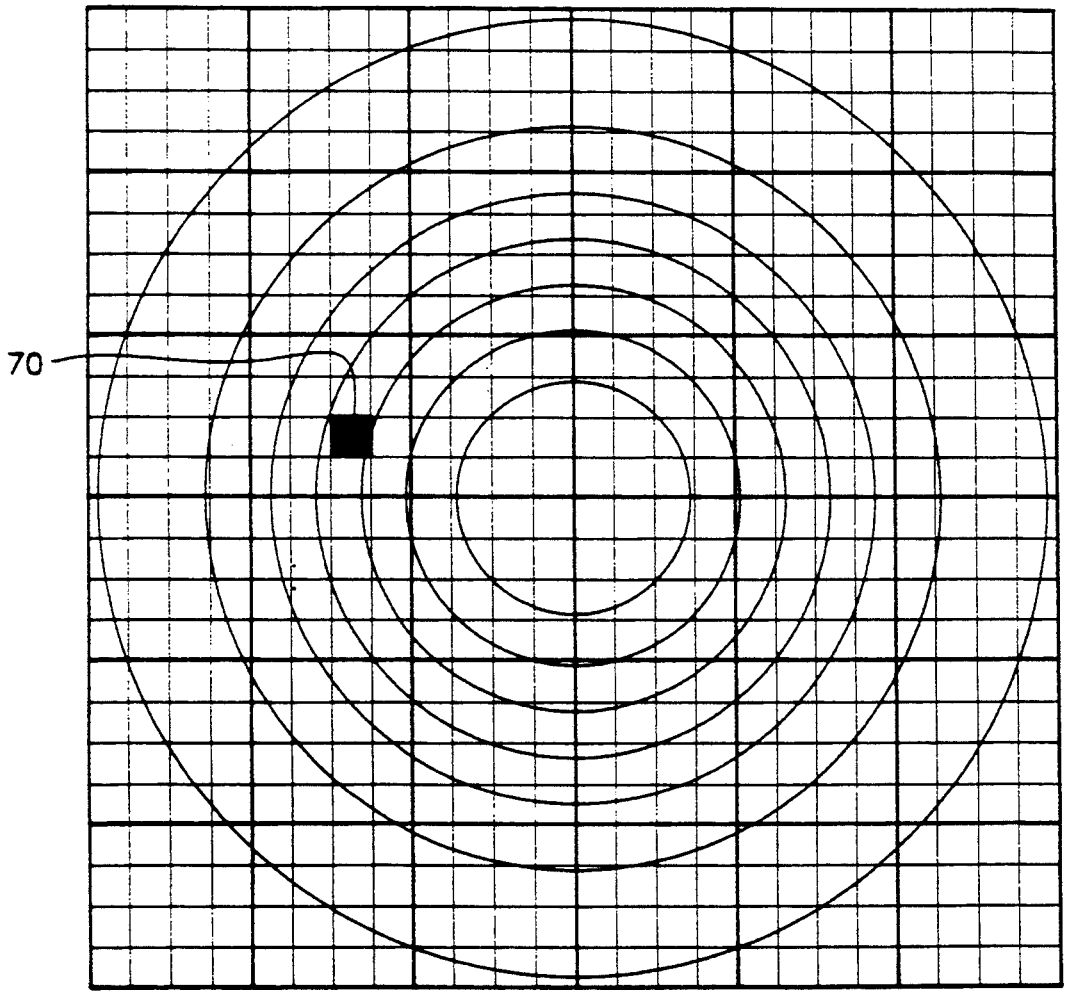
Figure 17:
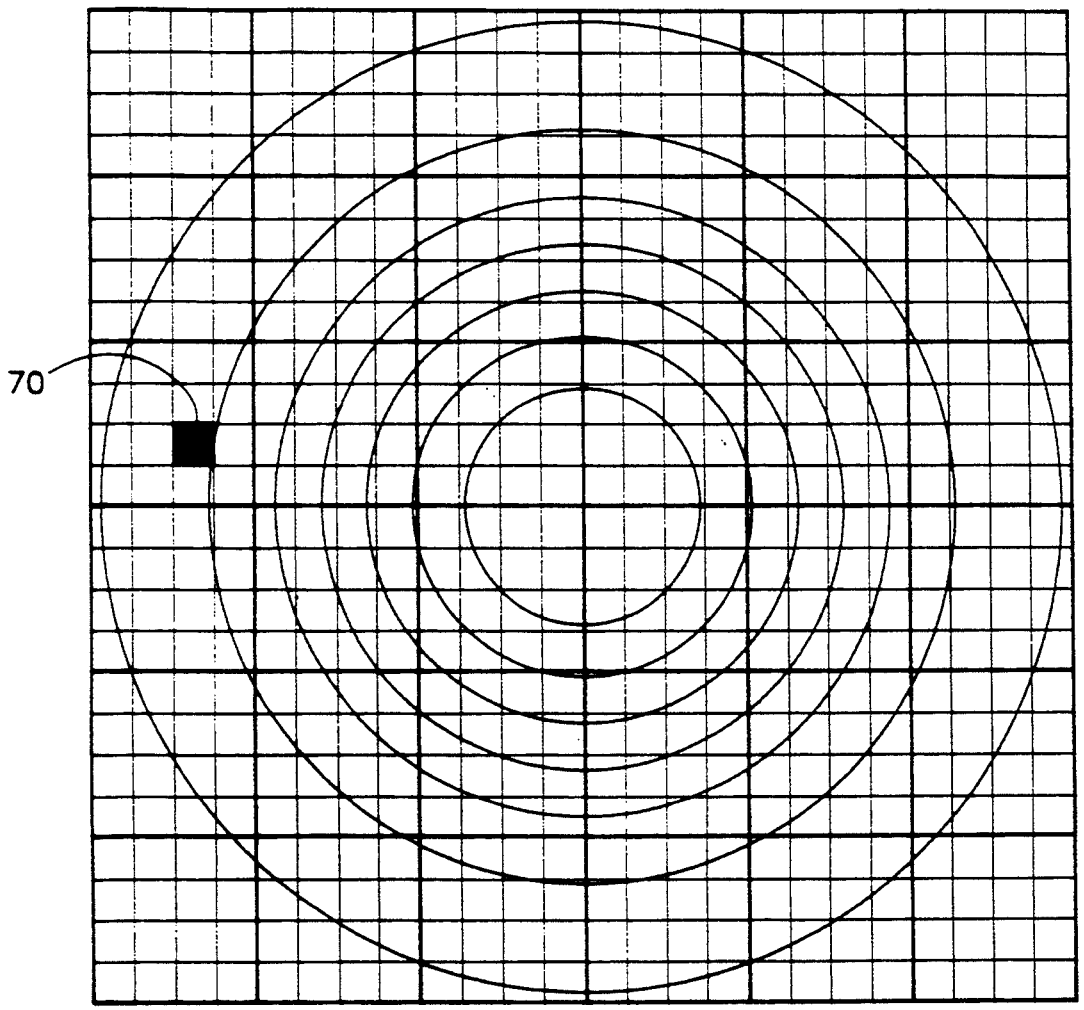
Figure 18:
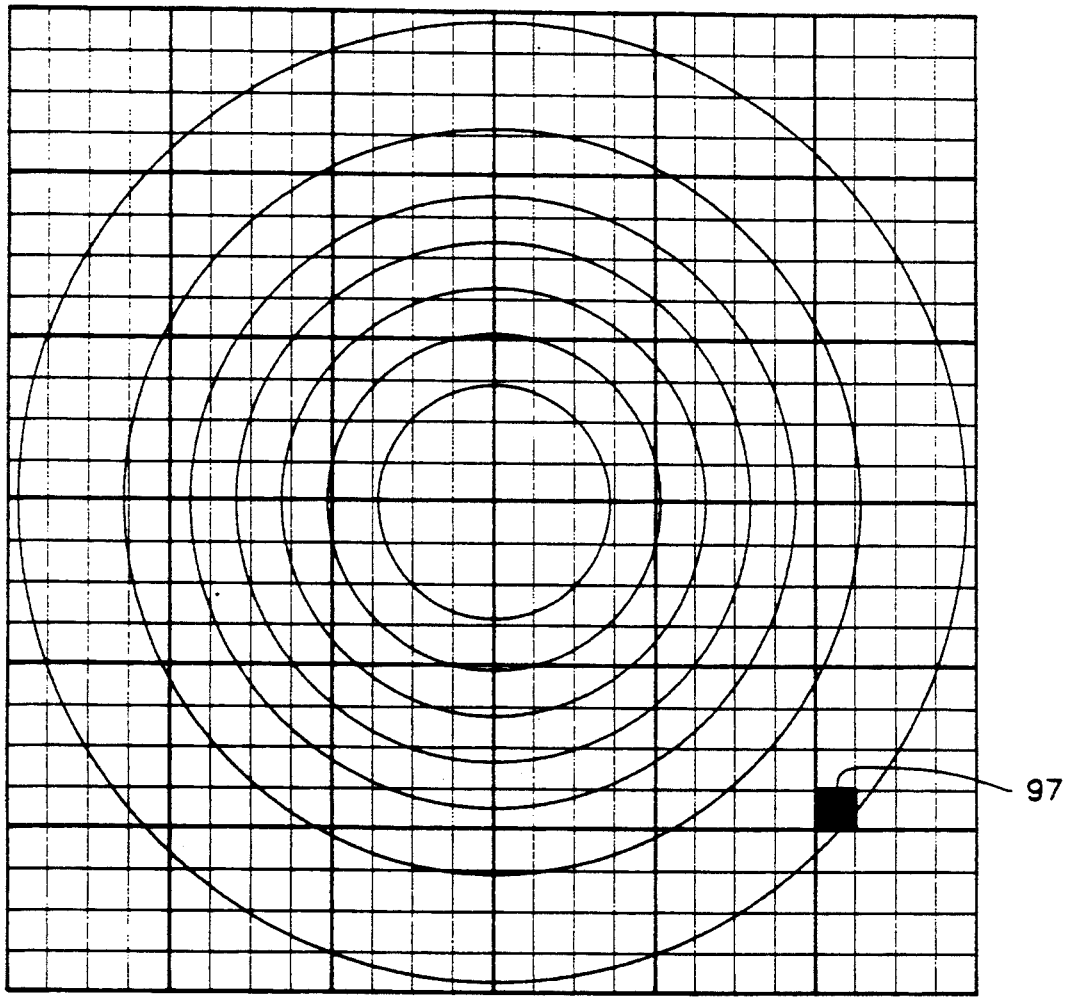
FIGS. 18–26 are sliding window examples similar to FIGS. 12–17 and showing three points in image memory near each other. The 9 figures represent the sliding window location for 9 consecutive frames in time.
Figure 19:
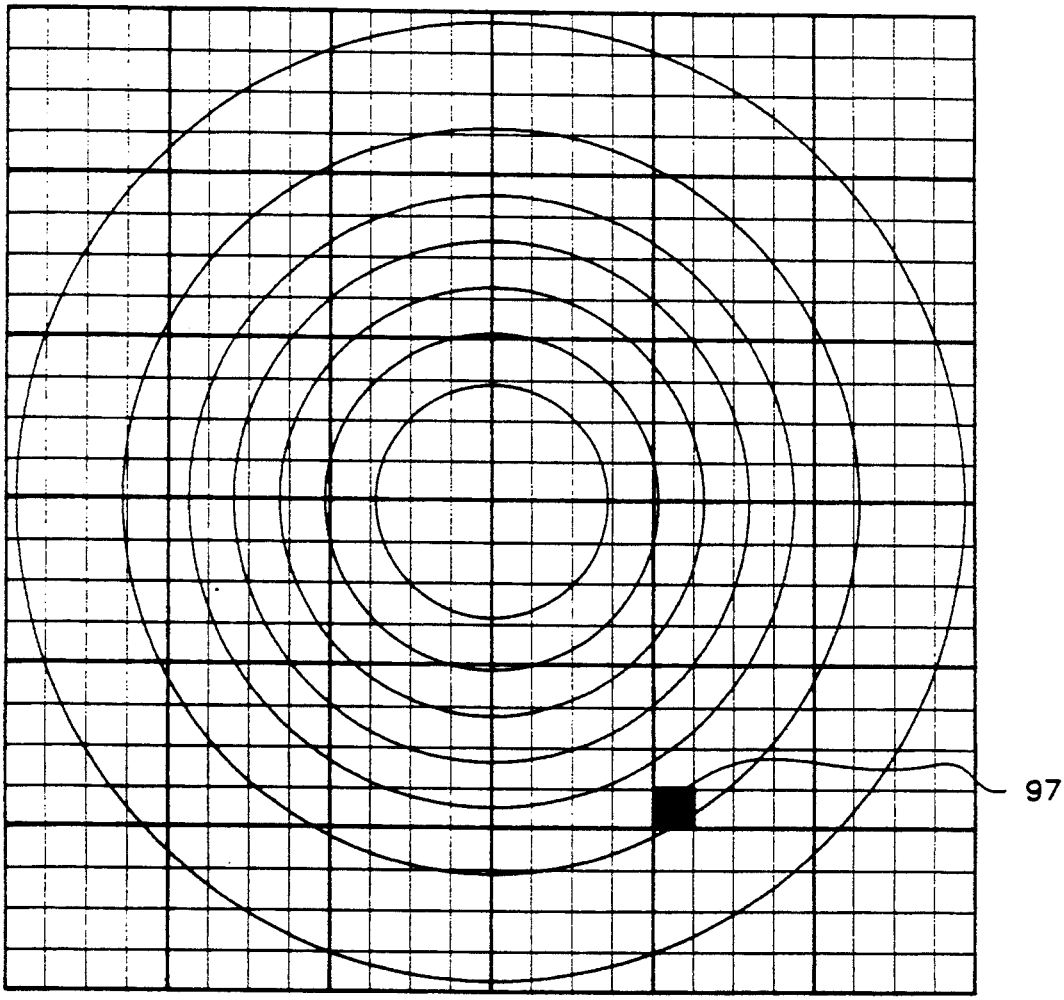
Figure 20:
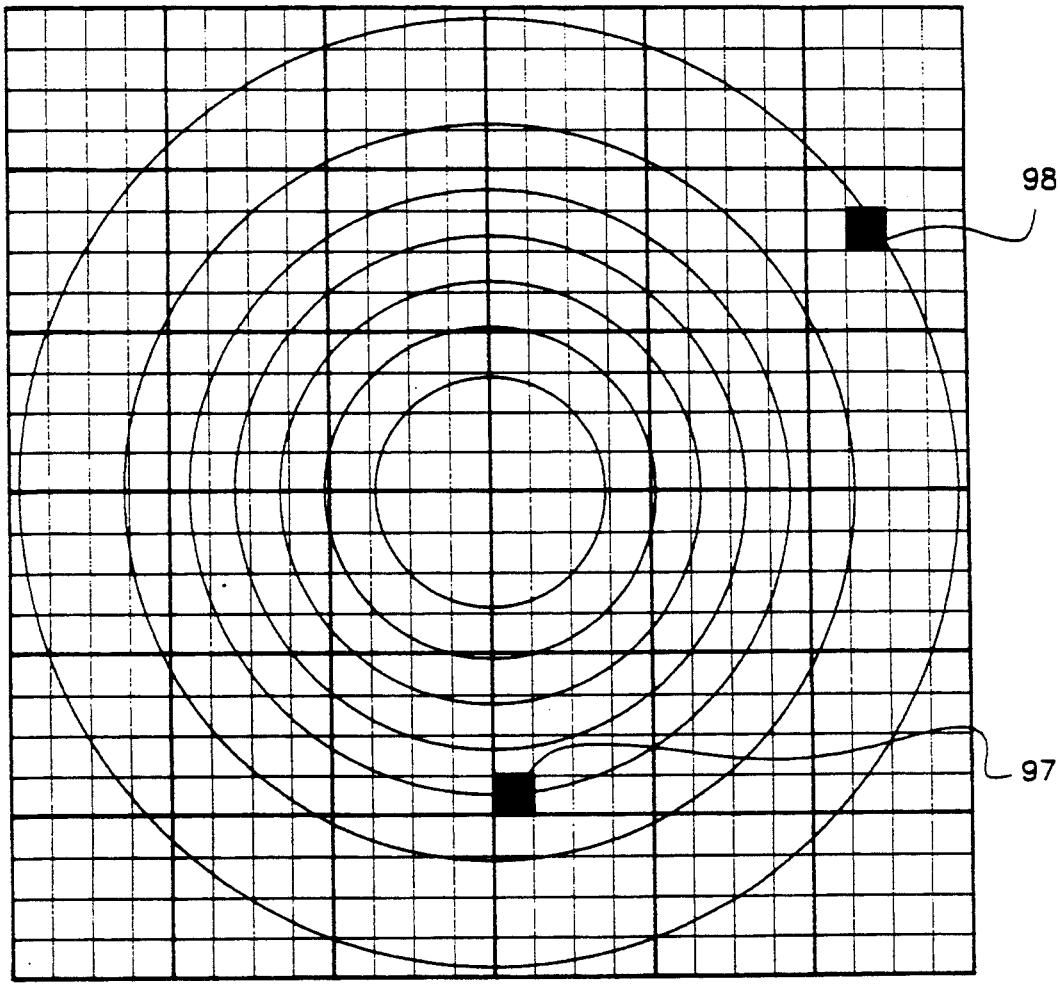
Figure 21:
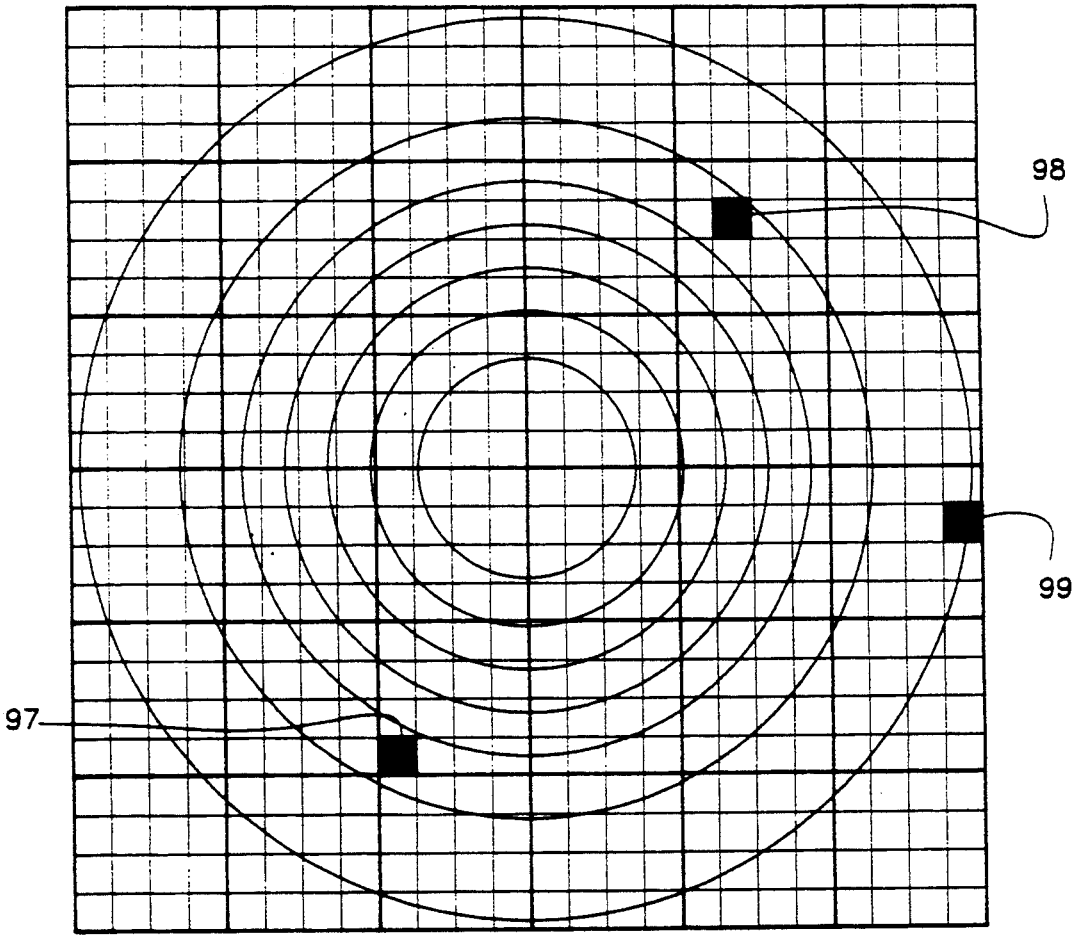
Figure 22:
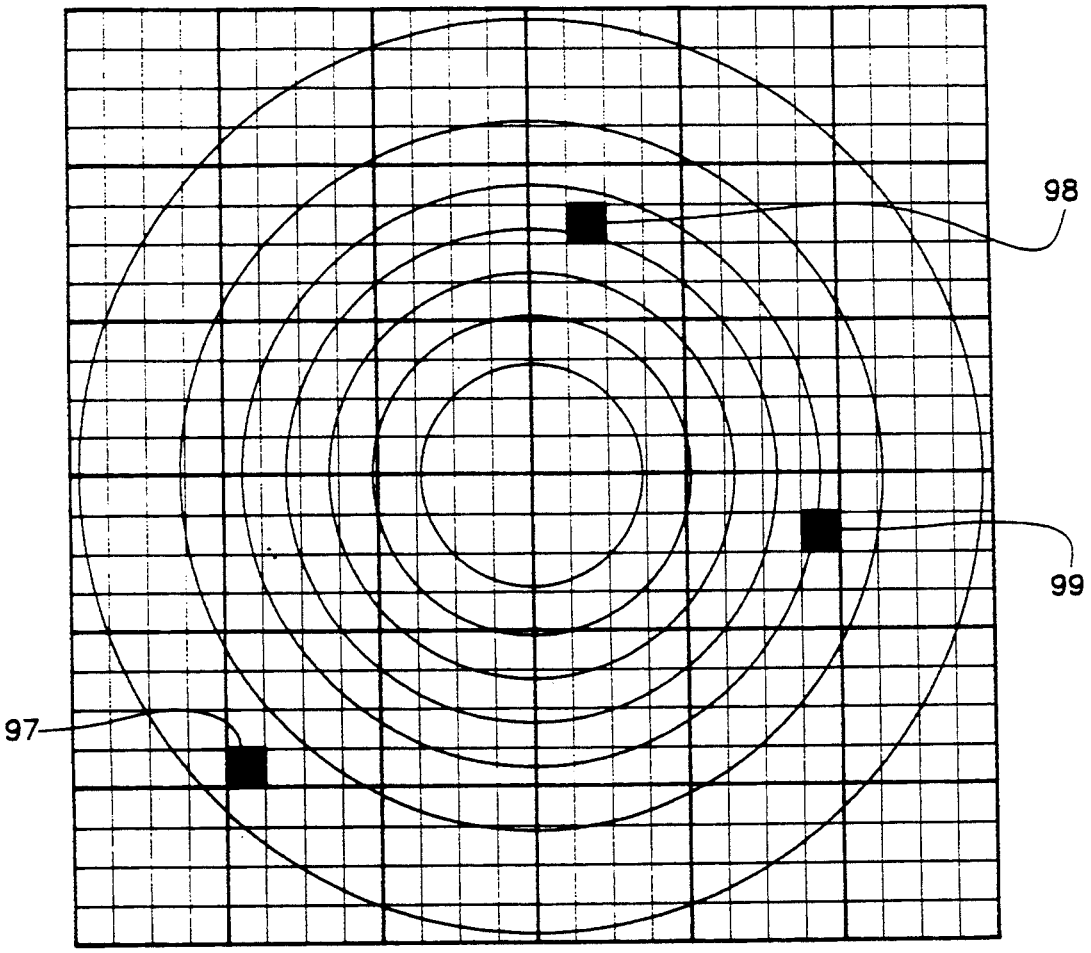
Figure 23:
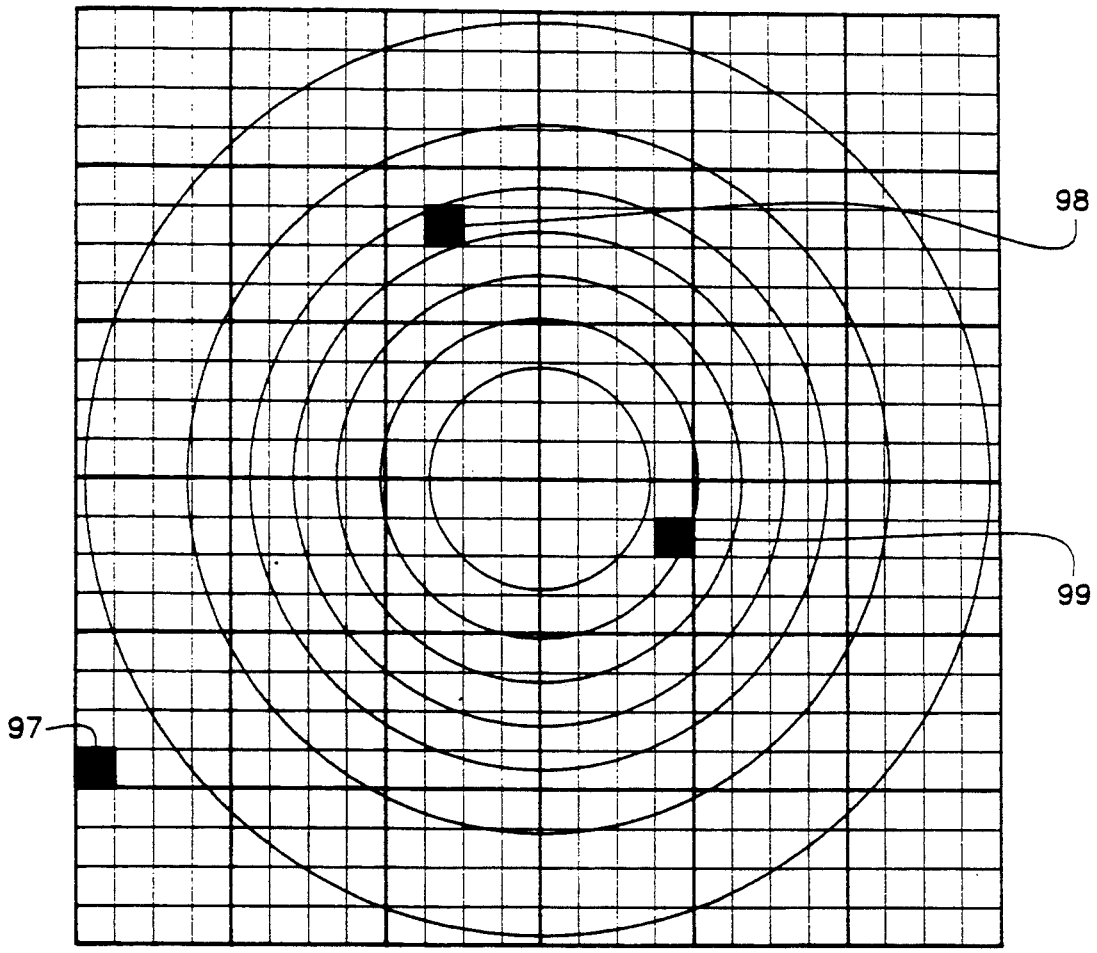
Figure 24:
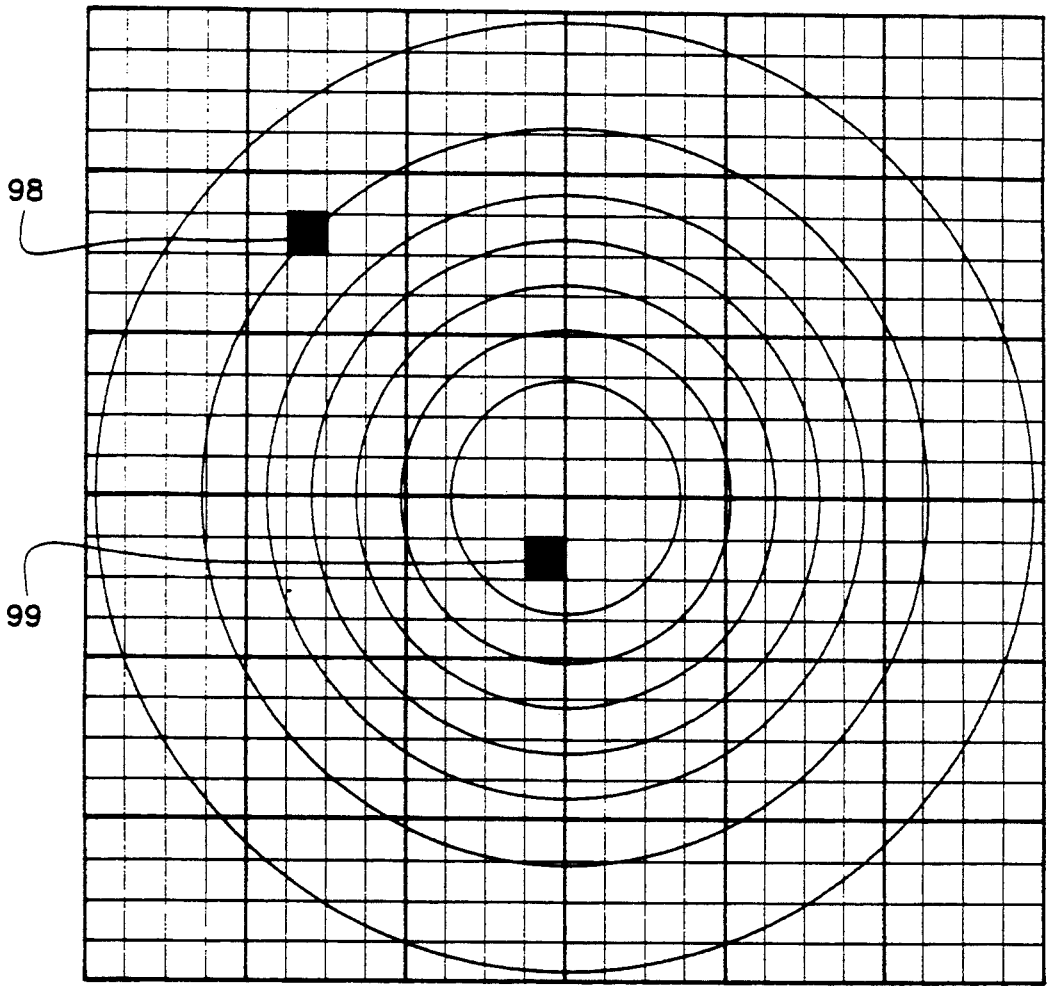
Figure 25:
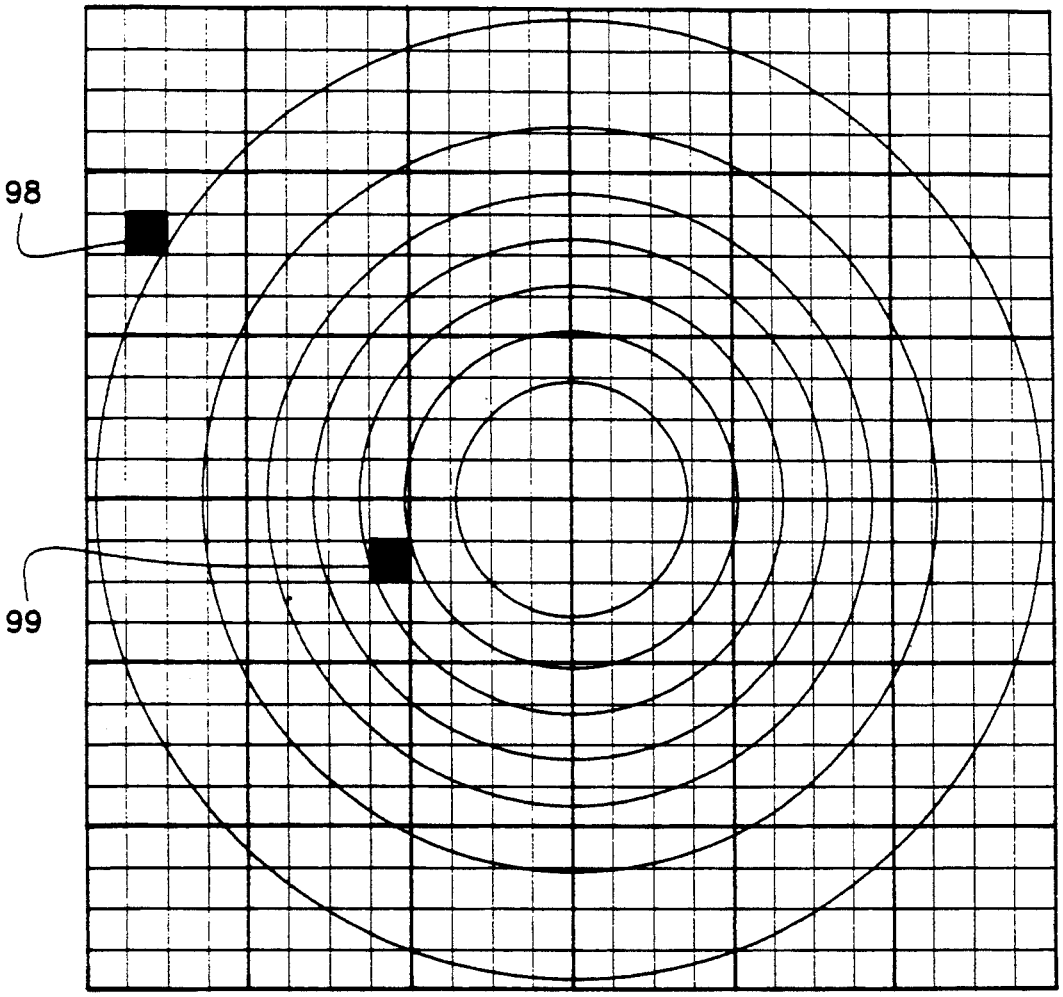
Figure 26:
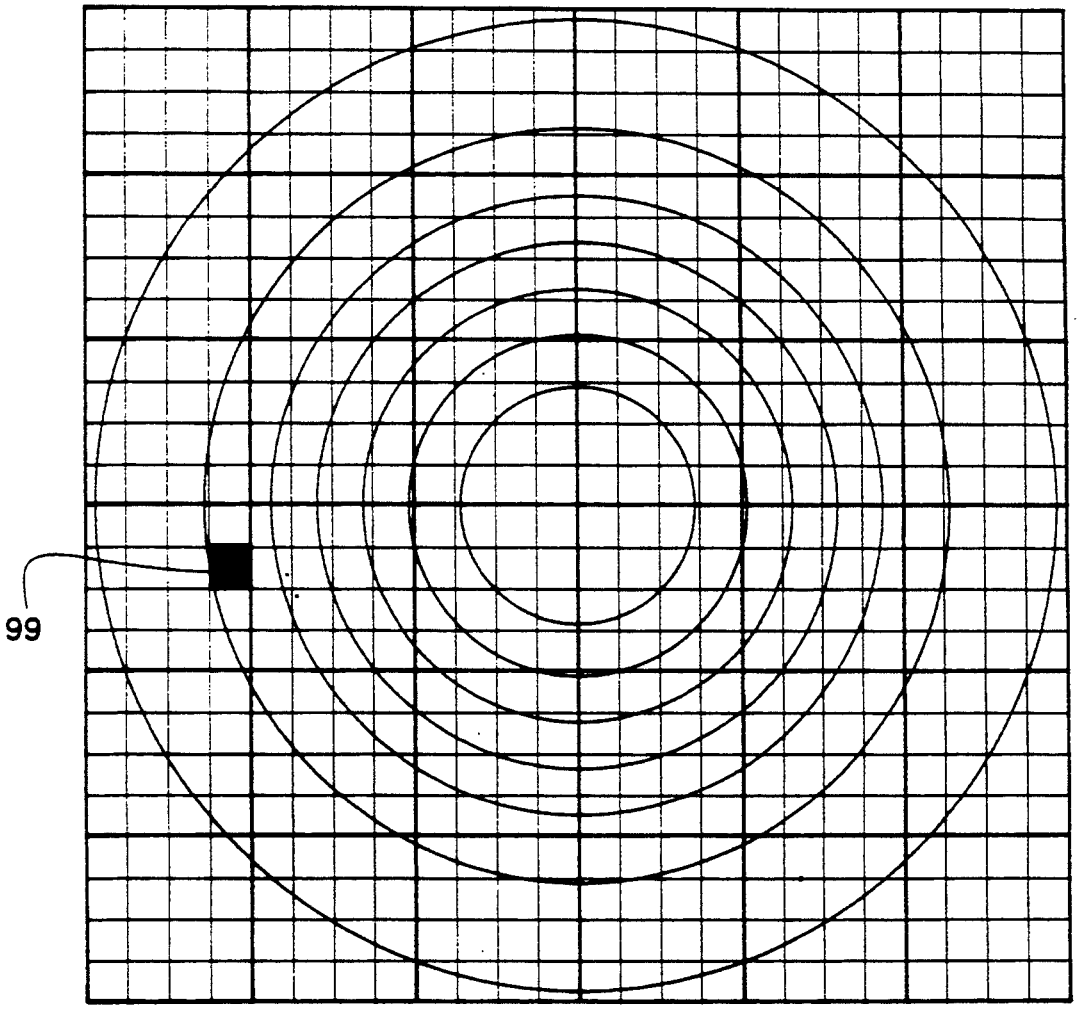

FIGS. 12–17 are considered as a group of frames in time. FIG. 12 illustrates a single data point 70 in image memory as it is to be filtered on one line 83 of the sliding window 72. All other points would have no contribution to the image The bold lines 80 to 86 and 90 to 96 represent pixel borders, in this case of a 6×6 window of pixels. The fine lines, such as 87 and 97 represent sub-pixel addresses, 16 per pixel in this example of FIG. 12. The circles 60–66 represent limits of each intensity level. In FIGS. 12–17 the window 72 is slid one pixel to the right with each succeeding frame so that there is apparent motion to the left of the single point 70 as the group of frames is perused in order. The six succeeding frames of FIGS. 12–17 and the intensity and output intensity this single data point 70 contributes is illustrated by the table below:

TABLE 1

| Frame | Intensity corresponding to data point | Output Intensity (max of all data points in window) |
|---|---|---|
| 1 | 1 | 1 |
| 2 | 3 | 3 |
| 3 | 6 | 6 |
| 4 | 7 | 7 |
| 5 | 4 | 4 |
| 6 | 1 | 1 |

The sub-pixel address is used to determine the intensity value to be used. The intensity is based on radial position, much like a topographical map. The innermost circle represents intensity level 7 and drops one level down per contour ring to 0 outside the outer circle.

Whereas FIGS. 12–17 illustrated an example of a single data point in image memory as it is filtered on one line of the sliding window, reference is now drawn to FIGS. 18–26, an example of multiple data points in image memory near each other as they are filtered through the sliding window on a single pass across the screen. The nine figures represent the sliding window for nine consecutive frames in time. First an intensity look-up is done for each point, then a comparison is made to find the maximum intensity. In this case the maximum intensity determined from comparing all active points in the window is used as the value output to the display. The Table 2 below summarizes three points 97, 98 and 99 in image memory near each other as they are filtered through the sliding window on a single line.

TABLE 2

| Frame | Left Point | Center Point | Right Point | Output Intensity (max of all in window) |
|---|---|---|---|---|
| 1 | 1 | — | — | 1 |
| 2 | 2 | — | — | 2 |
| 3 | 3 | 1 | — | 3 |
| 4 | 2 | 2 | 1 | 2 |
| 5 | 1 | 3 | 2 | 3 |
| 6 | 0 | 3 | 6 | 6 |
| 7 | — | 1 | 7 | 7 |
| 8 | — | 0 | 5 | 5 |
| 9 | — | — | 2 | 2 |

Figure 27:
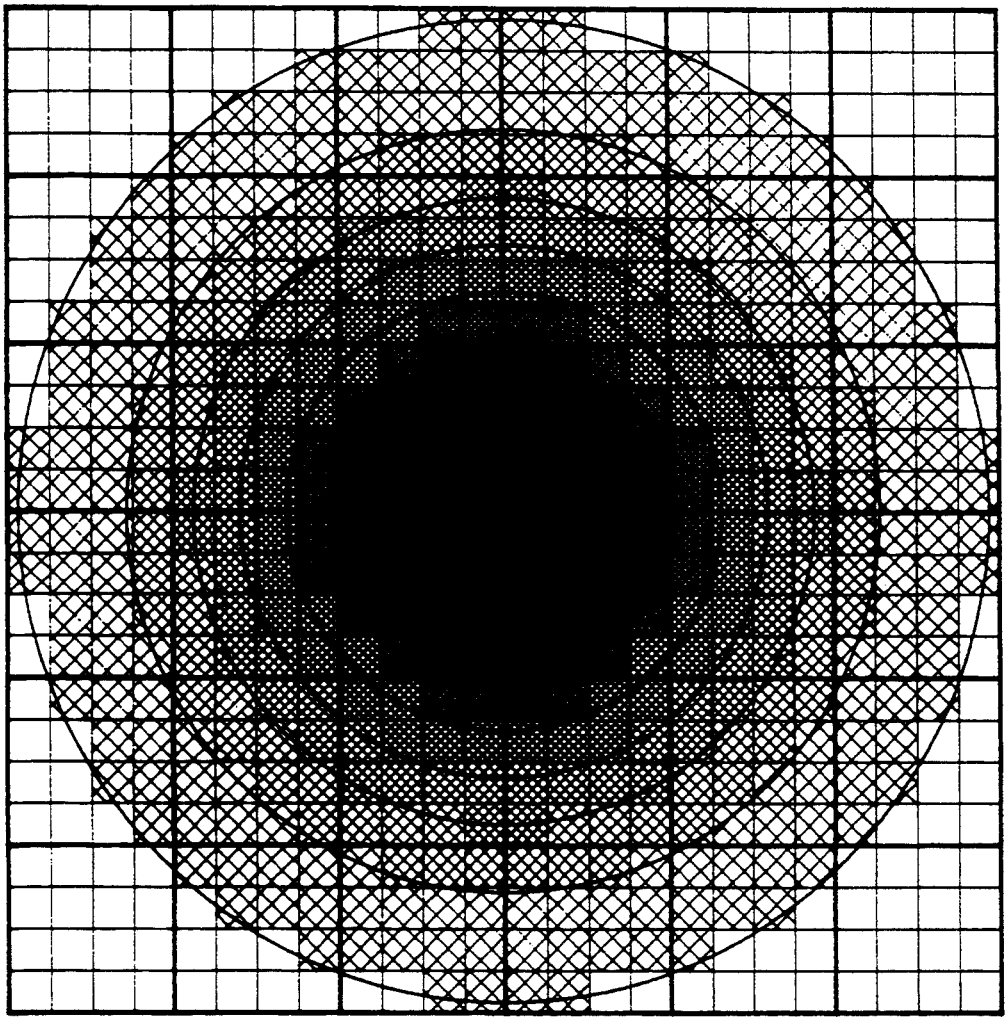
FIG. 27 is a gaussian profile based on 8 shades of gray. There is illustrated a luminance profile for 20 mil wide half-amplitude line drawn using 8 shades of gray. Pixel spacing assumed 6.7 mils.
Figure 28:
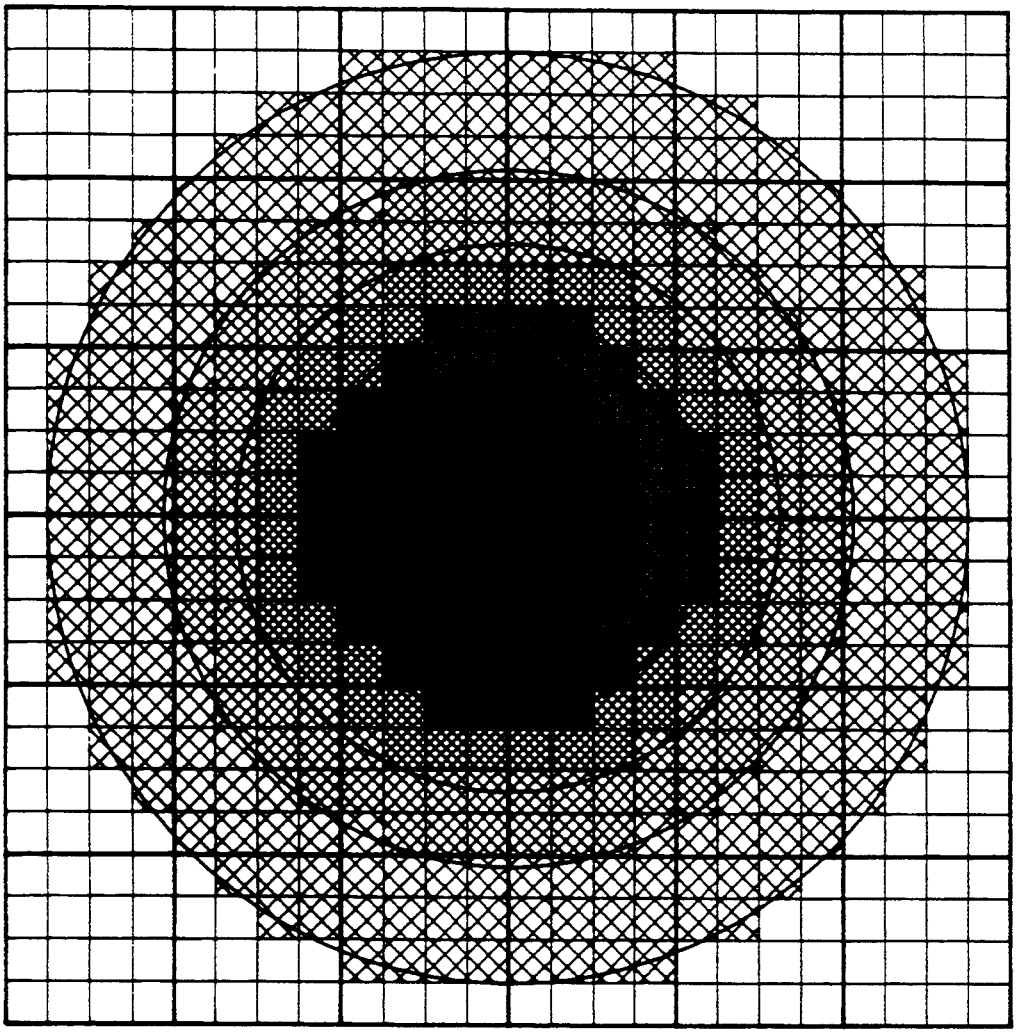
FIG. 28 is a gaussian profile based on 6 shades of gray. There is illustrated a luminance profile for 20 mil wide half-amplitude line drawn using 6 shades of gray. Pixel spacing assumed 6.7 mils.
Figure 29:
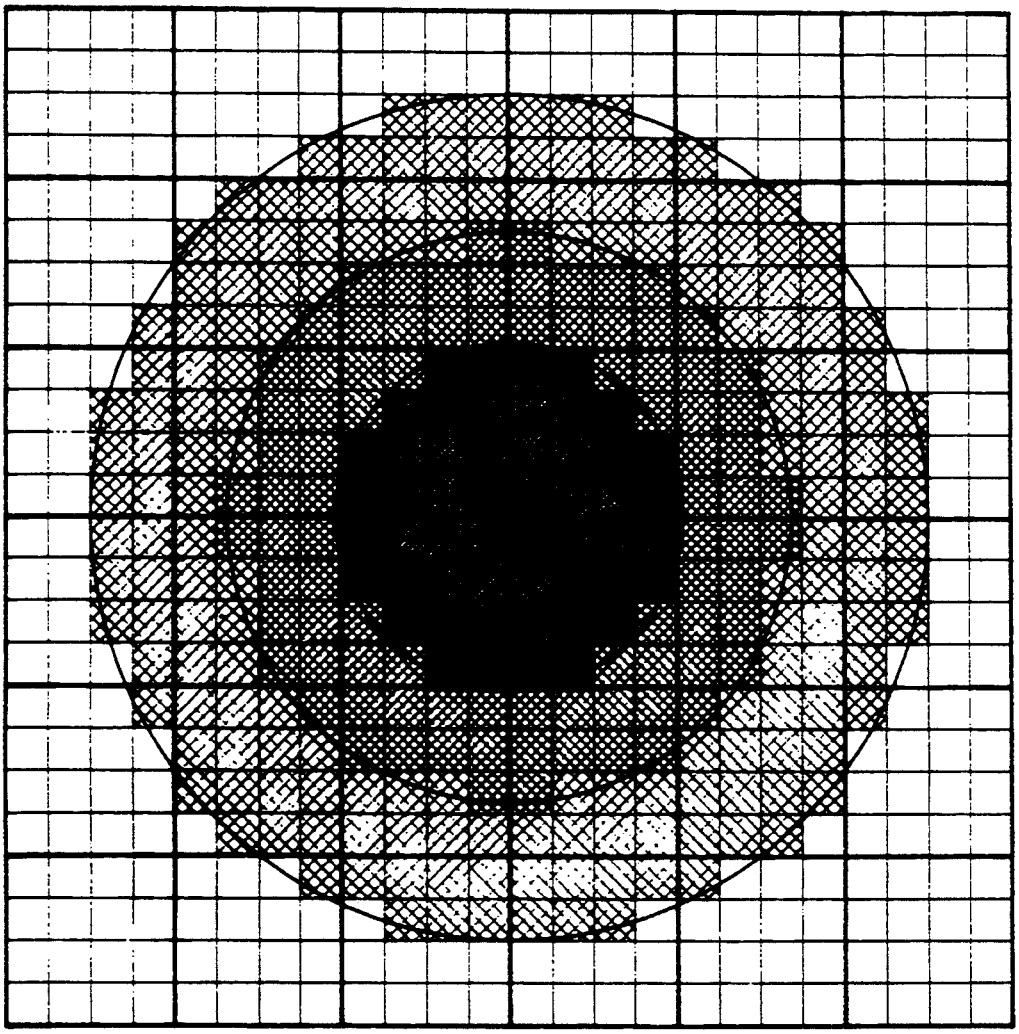
FIG. 29 is a gaussian profile based on 4 shades of gray. There is illustrated a luminance profile for 20 mil wide half-amplitude line drawn using 4 shades of gray. Pixel spacing assumed 6.7 mils.

The beamformer 23 can be used to produce anti-aliased data for lines of different brightness profiles. This is a change in the gaussian profile. Multiple brightness profiles can be used in a single beamformer. Processing of multiple brightness levels differs only in the initial gaussian profile used to determine the intensity level for each active pixel. A lookup is done for each pixel based on sub-pixel location and intensity level setting. Then all of the intensity levels are compared to find the maximum one for use as the output. Different brightness levels are handled in the lookup table. FIGS. 27, 28 and 29 show three different brightness intensity profiles. A number of these would typically be incorporated into the beamformer for anti-aliasing of multiple brightness levels.

Modified Vector Generator

In this invention a vector generator is a special purpose graphics generator. Digital Vector Generators typically draw lines and figures by incrementally calculating addresses of pixels and then commanding a write operation to each of these pixels. The general equation $(y1-y0)=m(x1-x0)$ is solved and used as the basis for computing the address for each pixel. This equation is broken into the parametric equivalent as $x_i=x_0+dx * i$ and $y_i=y_o+dy*i$ where $m=dy/dx$ and typically either dy or dx is set equal to 1.

Figure 30:
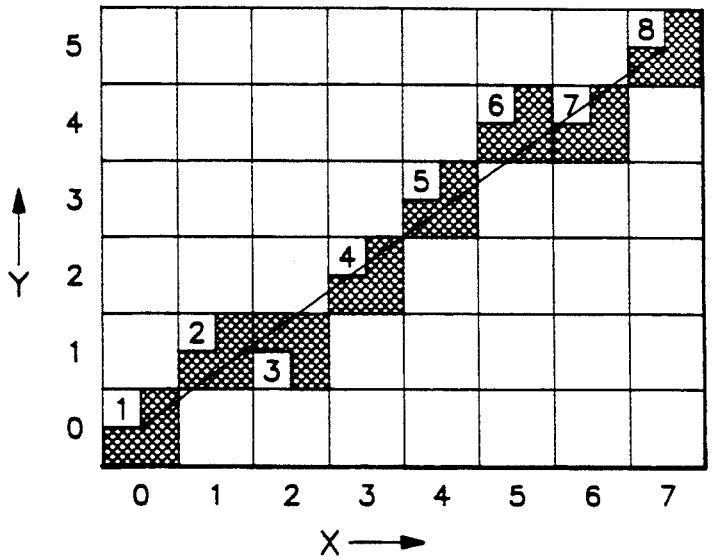
FIG. 30 shows a vector drawn in an image memory.
Figure 31:
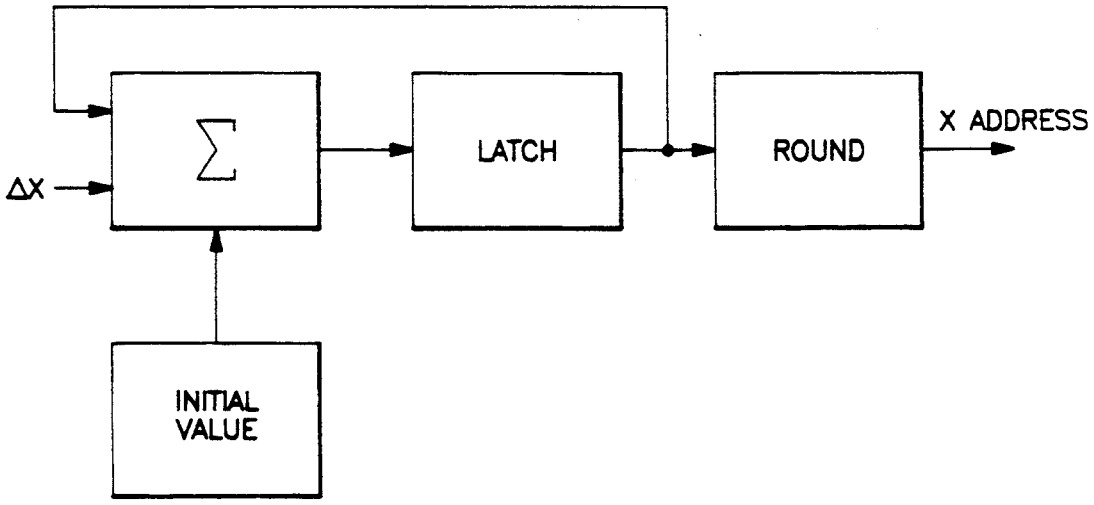
FIG. 31 shows a block diagram of a vector generator.

FIG. 30 shows a vector drawn in a conventional image memory from (0,0) to (7,5). The vector generator solves the basic equation to obtain a value for m. Since delta Y is less than delta X, this term is used to increment the Y address as the vector generator steps along the line. The X address is incremented by 1 each time. (If delta Y>delta X, then Y is incremented by 1 and X is incremented by 1/m.) FIG. 31 shows a functional block diagram of a typical vector generator for the X address. The starting point is first loaded into the accumulator. On each clock cycle, the accumulator adds the previous accumulator output (stored in the latch) with the increment specified by delta. The output from the latch is fed to a rounding circuit to generate the X address of the next pixel. The accumulator has sufficient precision to handle fractions. The rounding circuit rounds numbers to the integer values required for the pixel addressing circuit (for example, 27.862 would be rounded to 28). An identical circuit is used to generate the Y address. For FIG. 30, the initial values and increments for X and Y are:

| | Initial Value | Increment |
|---|---|---|
| X | 0.0 | 1.0 |
| Y | 0.0 | 0.714 |

Figure 32:
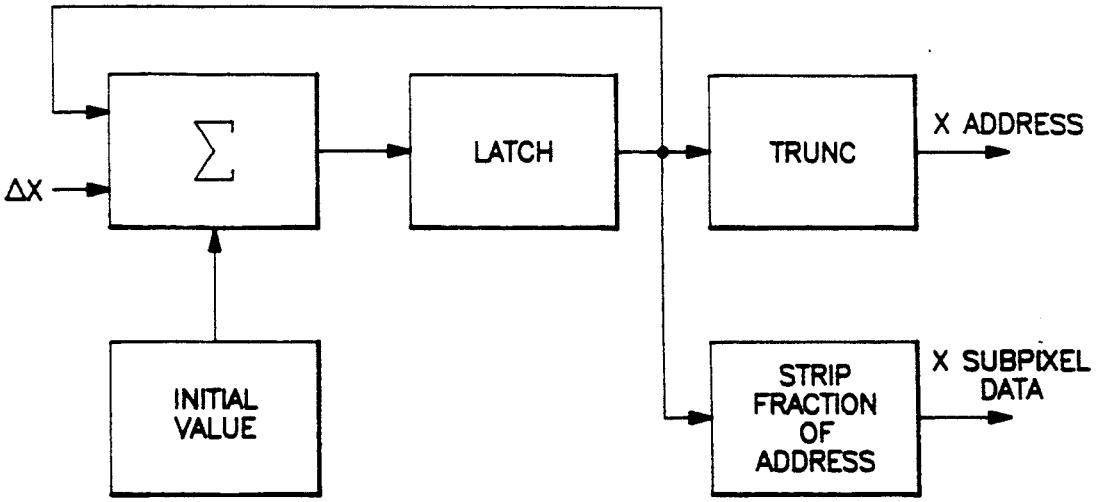
FIG. 32 shows a block diagram of a vector generator used with a beamformer.

A vector generator used with the beamformer takes advantage of the fractional information available from the accumulator. FIG. 32 shows a block diagram of vector generator used with a beamformer. It is similar to the one shown in FIG. 31 with two differences. The rounding circuit used in FIG. 31 is replaced with a truncating circuit to generate the pixel address. The latch output is fed to a new block which strips out the fractional portion of the pixel address. This fractional address information is stored inside the pixel as sub-pixel data along with the normal color and intensity data field. The sub-pixel data is stored in each pixel. As an example, 27.862 would be truncated to 27 for the integer address with 0.862 stored in the pixel as the sub-pixel data.

Figure 33:
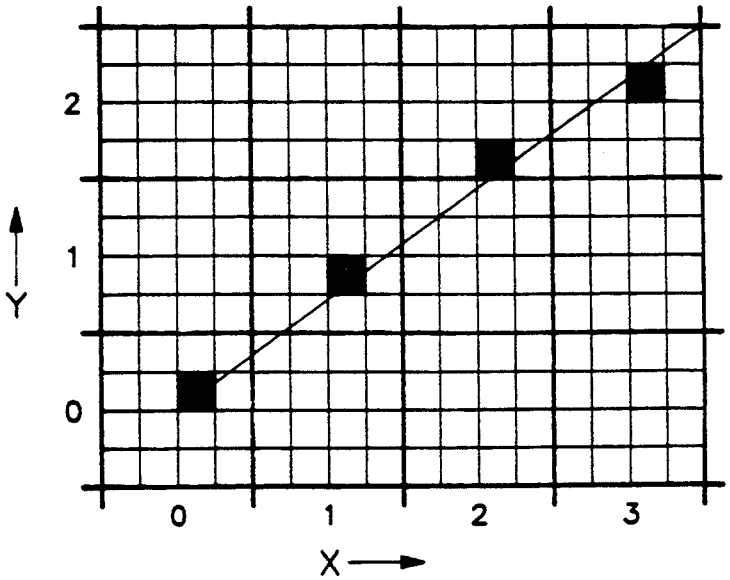
FIG. 33 shows a vector drawn using the modified vector generator of FIG. 32.

FIG. 33 shows a vector drawn using the modified vector generator. By storing the sub-pixel data inside each pixel, each pixel can be positioned very precisely FIG. 33 shows 16 sub-pixel locations per pixel. Comparing FIG. 33 with FIG. 30 illustrates how the sub-pixel data more finely positions the line center. (FIG. 33 is twice the size of FIG. 30).

MODIFIED IMAGE MEMORY

Background Information

Regarding Image Memory Design

In raster scan display devices, the electron beam traces across the screen in an orderly fashion, most often from left to right, top to bottom. Because the display devices utilize fast phosphors in order to render motion on the screen, the images generated disappear soon after being activated and therefore need to be refreshed at regular intervals, typically at a 60 Hz frequency.

In computer graphics generation systems, image refresh is accomplished by using a special refresh buffer, an image memory, typically implemented using solid state RAM technology. Each storage location in image memory is in one-to-one correspondence with each location on the screen. The image memory, then, can be visualized as a two dimensional array of storage locations addressed by an x address and a y address. These addresses are generated in synchrony with the electron beam scanning motion. The x address will typically increment from 0 to M−1, where M is the number of horizontal picture elements across the screen. Upon reaching M−1, the x address value is re-initialized to 0 and the y address is incremented. Y can begin at 0 at the top of the screen and ends at N−1, where N is the number of rows down the screen. M and N are frequently in the range of 512 for raster CRT displays, but are in the range of 1280 for color mosaic displays.

Each storage location contains data which is used to activate the electron guns on the CRT to some activation level corresponding to the intensity of light desired on the surface of the screen. Data are typically 8 bits for 256 gray levels per red, green or blue gun. So each memory location can be 24 bits deep. In color avionics systems, the number of bits is considerably lower, 3 bits generally, to denote any one of eight colors which may be on the screen at any one time. These 3 bits are passed through a look-up table, which decomposes the designated colors into the constituent primary color components. The ratio of the red, the green and the blue may be selected with 8 bit precision, providing a very broad color palette from which to choose the 8 colors.

Image memories, in the past, were implemented using static or dynamic RAM devices whose bandwidths were amplified to video rates by follow-up shift registers. A 16 pixel wide word would be read into a shift register 16 bins wide for example and then clocked out at the full speed of the shift register, much faster than the access time of the RAM. Today, these discrete methods of yesteryear are packaged into a single integrated circuit called a Video RAM or VRAM. These chips are highly efficient for implementing image memory designs and are used in the preferred implementation. Individually, they can provide enough storage to cover the entire screen for many applications.

The shift register allows the memory to be accessed by the computer while data is read to the CRT or display device. This permits an interweave of read and write cycles. The image can be drawn while its being shown. But, in real time applications in which a great deal of motion is depicted, picture update during screen refresh can result in visual artifacts. Old and new data can be mixed together on the screen creating gaps in the image and strange beat frequencies in the picture. To avoid these problems, a ping/pong image memory configuration (FIG. 34) is useful. In this configuration, one memory buffer is used to refresh the screen while another complete image memory buffer is allocated entirely to the graphics generator for rendering. When the generator has completed writing the picture, it notifies the hardware synchronization circuitry. This circuitry swaps the buffers during vertical retrace period when the video is blanked from being shown. The result is complete frames of the image can be presented at all times without visible interruption to image content.

Preferred Embodiment of Image Memory

In the invention any and all of the classic image memory configurations can be used. It does not matter whether dynamic memory chips or RAM chips are used. What is different is the storage depth and allocation. Storage is provided for sub-pixel data in addition to the usual color, priority and other attributes. The modified image memory is still accessible to the graphics generator and is still used to refresh the display device. A low cost read/write interweave image update may be used or, alternatively, a ping-pong configuration can be elected. In the preferred implementation (FIG. 34), using VRAM, the image memory is 512×512 pixels, in a ping-pong arrangement. Each pixel is 12 bits deep, 6 bits for color and an additional six bits for storing the sub-pixel data, 3 bits for x subaddressing and 3 bits for y subaddressing. These data when stored in this manner can be read from the modified image memory for processing by the beamformer device. Thus this is a read cycle oriented approach or process. FIG. 35 shows a modified ping or pong portion of the image memory.

Figure 34:
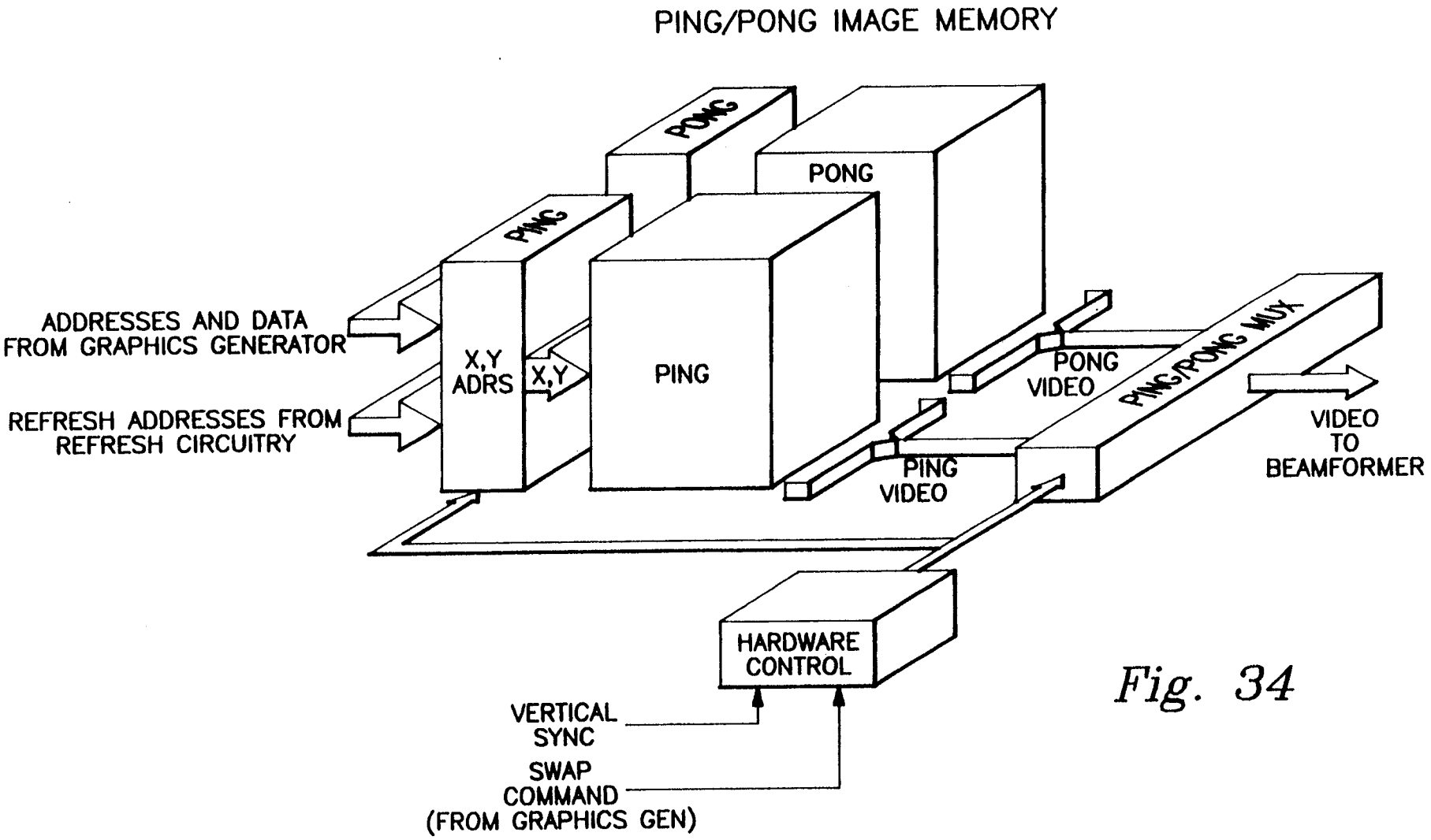
FIG. 34 shows an embodiment of a ping-pong image memory configuration.
Figure 35:
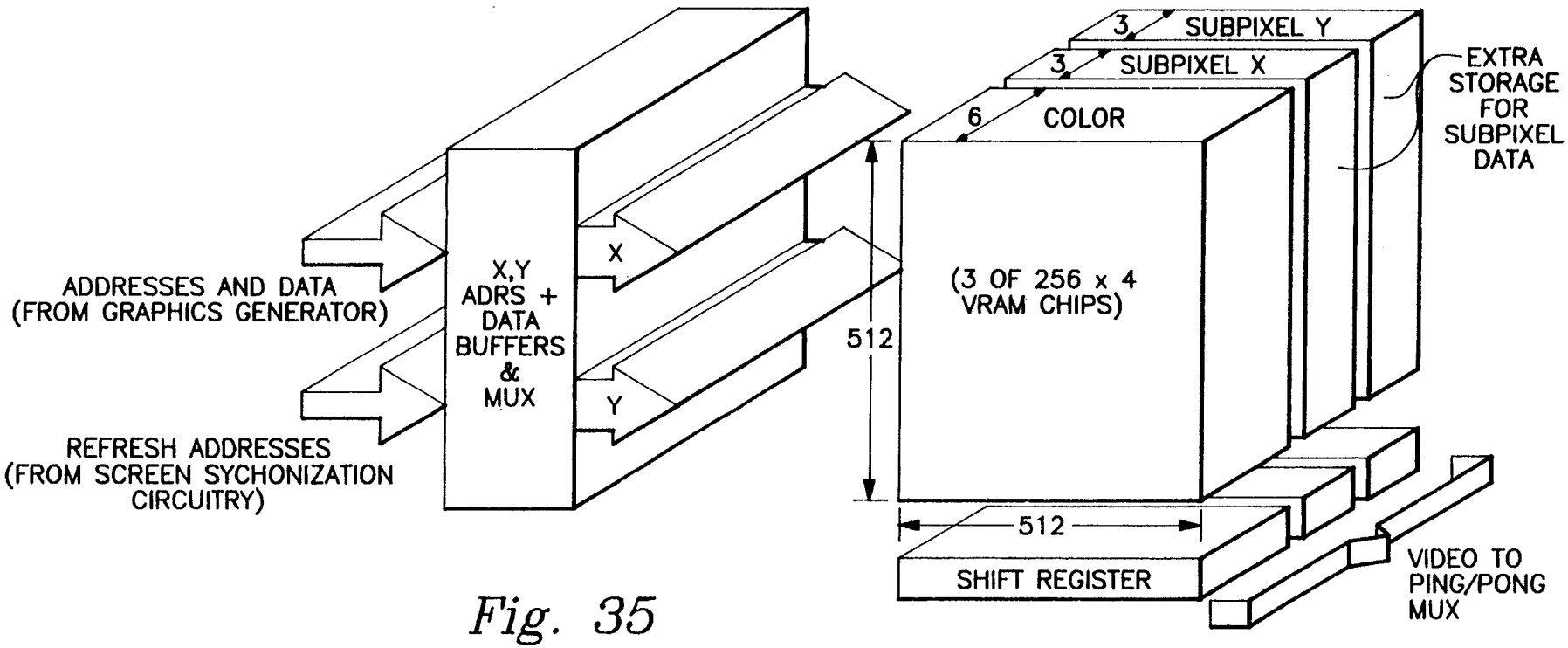
FIG. 35 shows a modified embodiment of a ping or pong portion of the image memory.

The accompanying FIGS. 34 and 35 provide a representation of this embodiment. For more information on image memory technology, please refer to the textbook titled "Fundamentals of Interactive Computer Graphics", by J. D. Foley and A. Van Dam, July 1984, pages 129–135.

PREFERRED IMPLEMENTATION OF BEAMFORMER

Output Section

Figure 36:
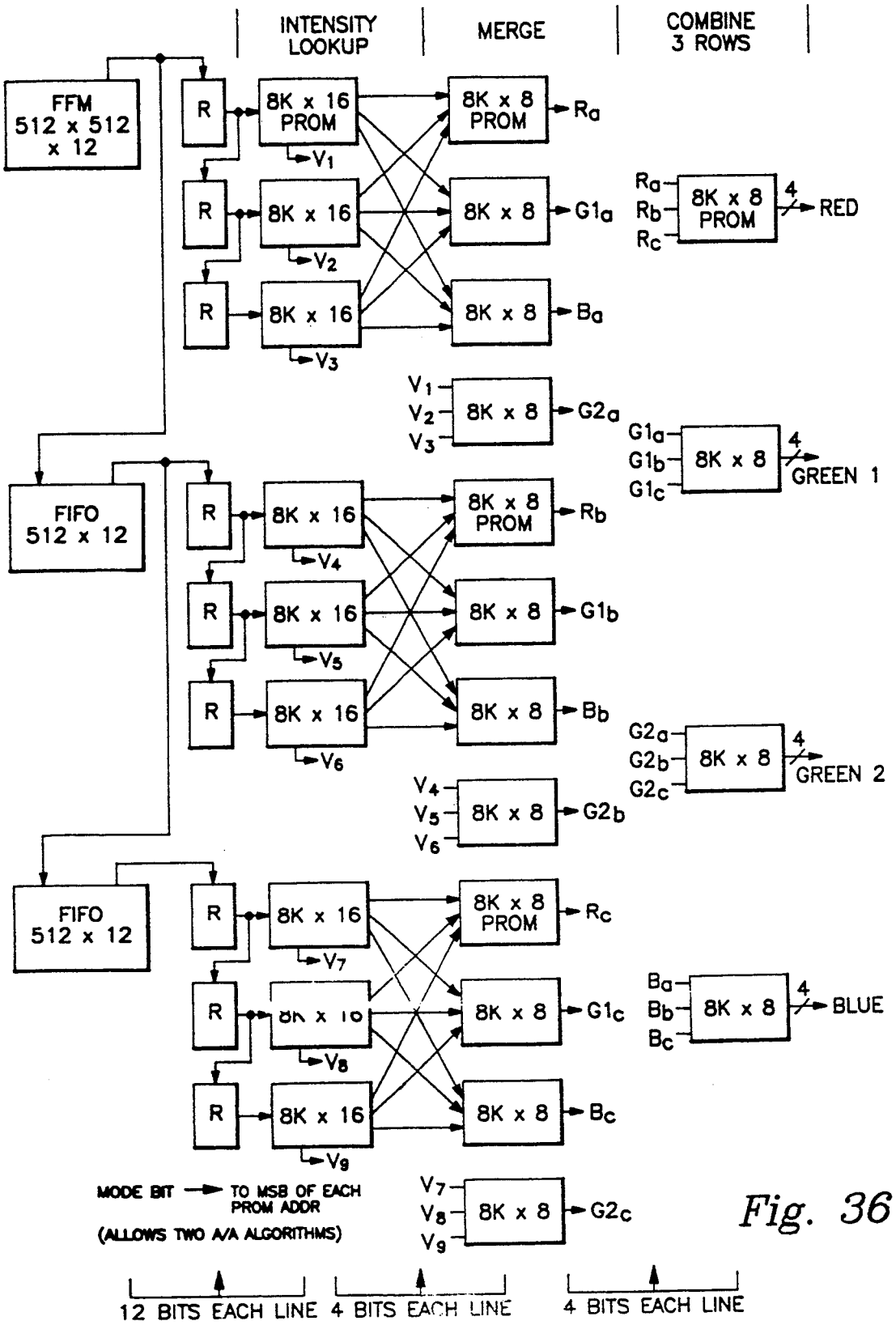
FIG. 36 shows an embodiment of a block diagram of data paths for processing a 3×3 kernel for generating color dot outputs.

The Block diagram FIG. 36 shows the data paths for processing a 3×3 kernel for generating the color dot outputs for a RGGB Quad flat panel. The center pixel of the 3×3 matrix is expanded into 4 outputs, one output for each of the color dots in the Quad arrangement. This allows the 512×512 full field memory (FFM, discussed in previous section) to be expanded to drive a 1024×1024 quad green flat green panel display. This block diagram can easily be expanded to yield other sizes of processing kernels or rearranged to drive other pixel patterns. The requirement for a 3×3 kernel means that the pixel data from the FFM must be scanned such that the FFM's output is always 1 row and 1 pixel ahead of the pixel address currently being processed. The 3×3 processing kernel requires 9 entries be present for each pixel. This is accomplished by the 2 512×12 bit FIFOs which delay pixels by one and two lines respectively. For each line there are 3 12-bit registers which are loaded sequentially. Thus the new pixel from each line loads the first register, while the 2nd register receives the 1st register's previous contents, and the 3rd register is loaded from the 2nd register's previous contents. Thus the 9 registers have at their output the contents of the 3×3 matrix for the processing of a given pixel. The top 3 registers hold 3 pixels from the next line of data, the middle 3 registers contain 3 pixels from the current line of data, and the bottom 3 registers contain 3 pixels from the previous line of data. Remember that the image memory is always one line of data ahead of the processing kernel.

The 12 bits of data for each pixel can contain any combination of color, intensity, and sub-pixel addressing. The preferred combination is 6 bits of color codes, 3 bits of x subaddressing and 3 bits of y subaddressing. This results in the beamformer producing 64 color/intensity combinations and the equivalent of 4096×4096 addressing from the 512×512 FFM. Another desirable bit assignment is 4 bits of color, 4 bits of intensity and 2 bits each of x,y sub-pixel addressing. This implementation of the beamformer can support two sets of bit assignments with a mode bit.

The left most set of 8 k×16 bit memories provide the initial conversion of pixel data into the RGGB component outputs. The memory requires 13 bits of addressing: 12 bits from the pixel data and one mode bit. The memories can be either RAM or PROM based. The contents of the memories are loaded with the color dot intensities corresponding to the position with the processing window for that pixel's data in each of the 9 matrix positions. Thus each memory will typically have different contents. The top-most memory, for instance, contains the conversion for the pixel which is one line ahead in y and 1 pixel ahead in x. As previously discussed, the pixel position and sub-pixel addressing will compensate for the distance of the pixel from the center of each of the color dots in calculating the color contribution of this pixel to the final output of each color dot. The 16 bit output of this first bank of memory provides 4 bits of intensity contribution for each of the color dots. For a color code of black, all color dots output 0 intensity, for a color code of white however, each color dots contribution will vary depending on the distance to the center of the color dot being generated. Notice that the 2 green outputs will frequently be different since the distance from these two dots is normally different with respect to the center of the 3×3 processing window. The distance being discussed here is from the center of the individual color dots being generated to the sub-pixel location in the pixel being processed (total of 9 pixels are being processed in parallel to generate the 4 color dots.)

The 16 bit outputs of the first set of memories are divided into 4 four-bit (R, G1, G2, and B.) The second set of memories in the diagram are responsible for merging the intensity data for each of the three rows such that each memory outputs the intensity contribution for that row for each of the 4 color dots. This second set of memories in this implementation are each 8 k×8 bits, where the 13 address bits are composed of 3 four-bit intensities and one mode bit. The mode bit permits two anti-aliasing intensity merging algorithms to be resident. The PROMs can either select the maximum intensity, sum the contributions linearly, or even perform non-linear addition on the intensity components. Any merging function can be loaded into these memories. Each of the three rows contains 4 of these memories. Each memory receives the 3 four-bit intensities from the first set of memories for a particular color dot. Thus each row outputs its intensity contribution for each of the 4 color dots. Note that only 4 bits of each 8 bit memory are needed (8 k×4 bits memories are not readily available.)

The third set of memories combines the outputs for each of the 3 rows to generate the final output for each color dot. Each memory receives the 3 four-bit intensities from each row for a particular color dot. Thus all 3 Red color dots (Ra,Rb,Rc) are routed to one memory (along with a mode bit) where those contributions are merged to generate the final Red color dot output. The merging algorithm is programmable but normally would be the same as was used in the second set of memories. The two sets of green intensities and the blue are also routed to separate memories to produce the final G1,G2 and B outputs. In this application only 4 bits of intensity are produced however 8 bits are actually available from the 8 k×8 memory.

For flat panel displays which use a different color dot arrangement, the architecture is easily rearranged. For RGB diagonal or delta patterns the color dots can still be arranged in groups of four, but the color dots will move around. However, at most, 3 different patterns occur (RGBR, BRGB, and GBRG), thus the architecture is modified to have 2 mode bits instead of one. Each memory then must have 16 k locations instead of 8 k. The mode bits then change each clock period to choose the memory area reserved for each of the color dot patterns. Notice that the final outputs are now based on position rather than just color (for RBBG quad panels color assignments do not change based on position.) Thus the upper output (of the four) drives the R for the RGBR pattern but B or G for the other two patterns. Thus the 512×512 FFM can still be expanded to fill all the color dots in a 1024×1024 flat panel independent of the color dot arrangements.

The embodiments of an invention in which an exclusive property or right is claimed are defined as follows:

1. A graphics system apparatus to apply an anti-aliasing filter to an output of an image memory configuration to improve the image quality of an active matrix display having one or more pixels each identified by unique addresses, comprising:

a modified graphics generator having an output means for providing standard integer x and y addresses corresponding to the unique addresses of said one or more pixels, and for providing data elements, including image data elements and sub-pixel or fractional address data elements representative of an image to be displayed;

a modified image memory including storage for said image data elements and said sub-pixel or fractional address data elements provided by said modified graphics generator at locations indicated by said standard integer x and y addresses, said modified image memory having an input connected to receive said image data elements and said sub-pixel or fractional address data elements from said modified graphics generator output means, said modified image memory having an output means for providing a sub-pixel output, including said sub-pixel or fractional address data elements; and a beamformer having a point spread function of gaussian profile with regard to intensity covering a window including a plurality of pixels around an output pixel, said beamformer including means for generating an intensity output for said output pixel as a function of said image data elements and said sub-pixel or fractional address data elements for one or more of said plurality of pixels in said window covered by said point spread function, said active matrix display having an input to receive said intensity output from said beamformer for display of said image on said display.

2. An apparatus according to claim 1, wherein the beamformer comprises:

sliding window means for moving said window including said plurality of pixels around said output pixel covered by said point spread function in a raster-like fashion to provide a plurality of windows of said data elements;

means for selecting data elements in one of said plurality of windows according to a plurality of colors, said selection means having an input means connected to said output means of said image memory and having a selection means output;

shade look-up means for determining intensity of said selected data elements for each of said plurality of colors utilizing said point spread function, said shade look-up means having an input connected to said selection means output and having a shade look-up output;

means for finding maximum shades for each color, said finding means having an input connected to said shade look-up output and having an output for providing said maximum shades as said intensity output to said display.

3. An apparatus according to claim 2, wherein said beamformer further includes a color encoding scheme matching a color pixel pattern of the active matrix display.

4. An apparatus according to claim 2, wherein the display is a liquid crystal flat panel color display.

5. An apparatus according to claim 1, wherein said modified graphics generator is a vector generator to draw lines and figures by incrementally calculating addresses of pixels of said display and commanding a write operation to said modified image memory for each of said pixels.

6. An apparatus according to claim 5, wherein said vector generator includes an accumulator with sufficient precision to handle fractions, a truncating circuit and a fraction-stripping block which strips out a fractional portion of a pixel address, wherein said vector generator utilizes said fractional portion available from the accumulator to store sub-pixel or fractional address data elements representative of said fractional portion in said modified image memory for use by said beamformer.

7. A method for improving the image quality of an active matrix display having one or more pixels identified by unique addresses, comprising the steps of:

providing standard integer x and y addresses corresponding to said unique addresses of said one or more pixels and providing data elements including image data elements and sub-pixel or fractional address data elements representative of an image to be displayed;

storing the image data elements and sub-pixel or fractional address data elements at locations of an image memory as indicated by said standard integer x and y addresses;

addressing said image memory to provide a sub-pixel output, including said sub-pixel or fractional address data elements;

expanding said sub-pixel output into a point spread function, said point spread function having a gaussian profile with regard to intensity covering a window of a plurality of pixels around an output pixel;

generating an intensity output for said output pixel as a function of said image data elements and said sub-pixel or fractional address data elements for one or more of said plurality of pixels in said window covered by said point spread function; and providing said intensity output to said active matrix display to finely position light energy on said display.

8. A method according to claim 7, wherein said active matrix display is a monochromatic or color display.

9. A method according to claim 8, further comprising the step of providing a color encoding scheme matching a color pixel pattern of the active matrix display.

10. The method according to claim 7, wherein said generating step comprises the steps of:

sliding said window including said plurality of pixels around said output pixel in a raster-like fashion to provide a plurality of windows of data elements;

selecting data elements in one of said windows according to a plurality of colors;

determining an intensity of said selected data elements for each color utilizing said point spread function;

finding a maximum shade for each color as a function of the intensity for said selected data elements;

providing said maximum shades as said intensity output to said display.

11. A method according to claim 10, wherein said selecting step comprises the step of decomposing a color of one of said data elements in one of said windows representative of a pixel of said image memory into primary color components which comprise a color mosaic pattern of a particular display.

12. The method according to claim 11, wherein said finding step comprises the stp of combining intensity contributions from said selected data elements in a window so as to generate said maximum shade for a color to be part of said intensity output.

13. A method according to claim 7, wherein said expanding and generating steps include the step of determining intensity of each sub-pixel or fractional address data element in a window as a function of a distance from a center of said window and said point spread function having a luminance profile which decreases in intensity as said distance from the center becomes larger.

14. The method of claim 13, wherein said expanding and generating steps further include the step of combining intensity contributions from all the sub-pixel or fractional address data elements within said window having an intensity associated therewith so as to generate said intensity output.

* * * * *